US010427825B2

(12) United States Patent
Buehrle

(10) Patent No.: US 10,427,825 B2
(45) Date of Patent: Oct. 1, 2019

(54) PORTABLE CANTEEN WITH STORAGE COMPARTMENTS

(71) Applicant: Houston Max Buehrle, Carlsbad, CA (US)

(72) Inventor: Houston Max Buehrle, Carlsbad, CA (US)

( * ) Notice: Subject to any disclaimer, the term of this patent is extended or adjusted under 35 U.S.C. 154(b) by 0 days.

(21) Appl. No.: 15/647,229

(22) Filed: Jul. 11, 2017

(65) Prior Publication Data

US 2018/0016051 A1 Jan. 18, 2018

Related U.S. Application Data

(60) Provisional application No. 62/362,852, filed on Jul. 15, 2016.

(51) Int. Cl.

| | |
|---|---|
| ***B65D 1/04*** | (2006.01) |
| ***B65D 1/02*** | (2006.01) |
| ***B65D 43/02*** | (2006.01) |
| ***B65D 81/38*** | (2006.01) |
| ***B65D 23/02*** | (2006.01) |
| ***B65D 81/32*** | (2006.01) |

(52) U.S. Cl.

CPC ..... *B65D 1/04* (2013.01); *B65D 1/0246* (2013.01); *B65D 23/02* (2013.01); *B65D 43/0202* (2013.01); *B65D 81/3216* (2013.01); *B65D 81/3841* (2013.01)

(58) Field of Classification Search

CPC .. B65D 1/04; B65D 81/3216; B65D 81/3205; B65D 81/3841; B65D 25/10; B65D 25/108; B65D 23/02; B65D 43/0202; B65D 25/02

USPC ..... 220/23.83, 23.86, 23.87; 206/217, 216

See application file for complete search history.

(56) References Cited

U.S. PATENT DOCUMENTS

| | | | | |
|---|---|---|---|---|
| 2,326,414 | A | 1/1940 | Thompson | |
| 2,292,413 | A * | 8/1942 | Taylor | B65D 23/14 15/258 |
| 2,836,323 | A * | 5/1958 | Robinson | B65D 71/00 215/10 |
| 3,405,899 | A | 10/1968 | Trachtenberg | |
| 3,732,999 | A | 5/1973 | Rounkles | |
| 4,427,123 | A * | 1/1984 | Komeda | A47J 41/028 215/12.2 |
| 5,040,719 | A | 8/1991 | Ballway | |
| 5,086,926 | A | 2/1992 | Paige | |
| 5,535,889 | A | 7/1996 | Lin | |

(Continued)

*Primary Examiner* — Steven A. Reynolds

(74) *Attorney, Agent, or Firm* — Eric Kelly

(57) ABSTRACT

Canteens with storage compartments are described. Such canteens may have a main body with two separate and distinct cavities, each of which may function as a storage compartment. Such two different cavities may be a top cavity and a bottom cavity. Such two different cavities may be longitudinally disposed of each other, such that a bottom portion of the top cavity is disposed above a roof portion of the bottom cavity. A volume of the bottom cavity may extend, at least partially, into a volume of the top cavity in a manner that is radially symmetrical about a shared central longitudinal axis of both the top cavity and the bottom cavity; and in a manner where these two different volumes remained sealed from each other. The top cavity may be for beverages. The bottom cavity may removably store credit cards and/or a smartphone.

21 Claims, 22 Drawing Sheets

(56) References Cited

U.S. PATENT DOCUMENTS 5,653,124 A * 8/1997 Weber ..... A47G 19/2288 62/457.3
5,769,680 A * 6/1998 Hoffman ..... A47G 19/2227 206/217
5,829,607 A 11/1998 Ibrahim
6,145,685 A 11/2000 Dick
6,179,146 B1 1/2001 Betras
6,640,813 B2 * 11/2003 Raisner ..... A45C 11/008 132/200
6,719,159 B2 4/2004 Chomik
7,010,935 B2 * 3/2006 Citrynell ..... A47G 19/2255 62/457.3
7,614,512 B2 11/2009 Nader
7,798,346 B2 9/2010 Nelson
7,914,165 B2 * 3/2011 Bertken ..... A47G 19/2227 362/101
8,342,346 B2 * 1/2013 Rances ..... B65D 21/083 220/23.83
8,365,941 B2 2/2013 Mayer
8,474,648 B1 7/2013 Ritzen
8,504,127 B2 8/2013 Altschul
9,216,843 B2 * 12/2015 Sorensen ..... B65D 21/0228
9,511,003 B2 * 12/2016 Medrano ..... A61J 7/0409
9,743,803 B2 * 8/2017 Foster ..... B65D 81/3211
9,950,827 B1 4/2018 Lau
2004/0065565 A1 * 4/2004 Buesching ..... B65D 1/04 206/217
2005/0098526 A1 * 5/2005 Catalin ..... B65D 21/0231 215/6
2006/0201900 A1 9/2006 de Francesco
2008/0035646 A1 * 2/2008 Smith ..... B65D 21/083 220/526
2009/0188884 A1 7/2009 Nelson
2014/0238949 A1 8/2014 Patel
2014/0374370 A1 12/2014 Nowzari
2016/0198877 A1 7/2016 Ni
2016/0221721 A1 8/2016 Ni

* cited by examiner

PORTABLE CANTEEN WITH STORAGE COMPARTMENTS

PRIORITY NOTICE

The present application claims priority under 35 U.S.C. § 119(e) to U.S. Provisional Patent Application Ser. No. 62/362,852 filed on Jul. 15, 2016, the disclosure of which is incorporated herein by reference in its entirety.

TECHNICAL FIELD OF THE INVENTION

The present invention relates in general to double hulled insulating beverage bottles and more specifically to such bottles with additional storage compartments integral to a main body of the bottle, including a specialized compartment configured to hold credit cards, identification cards, and/or a smartphone the like.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Circa June 2016, the state of the art for double walled (double hulled) insulated bottles does not teach a specifically shaped card compartment for removable storage of cards, such as, but not limited to, credit cards, ATM cards, identification cards (such as a driver's license), social security cards, insurance cards, membership cards, coupon cards, business cards, and/or the like; wherein this card compartment is not visible from an exterior of the bottle; wherein this compartment has portions which might occupy a major volume of the bottle, where that major volume is for removable storage of a beverage; wherein access to this card compartment is from a lower end of a main body of the bottle only after a bottom lid that forms a bottom storage compartment is removed; and wherein the bottom storage compartment is of a size that would not be able to store such cards.

Some prior art does teach use of removably attachable bottom storage compartments and where such bottom storage compartments have an inside usable height of greater than 3.375 inches (8.477 centimeters [cm]) then a contemplated card could be stored within such a bottom compartment. However, when the bottom storage compartment is of this size or bigger, it is obvious from a perspective of an observer observing an exterior of the bottle that this relatively largely sized bottom storage compartment could hold cards of interest and thus be a subject of theft. It would be desirable to have bottle with a card compartment that is not visible from the exterior of the bottle and wherein such a bottom storage compartment appears exteriorly to be too small to accommodate storage of such cards; but wherein in reality the bottom storage compartment, that may be exteriorly hidden, may in fact be sized and shaped to accommodate storage of at least one credit card and/or similarly sized article/object.

There is a need in the art for a double hulled insulated canteen with a card cavity that is not visible from an exterior of the canteen, wherein portions of the card cavity extend into an inner cavity for removable storage of a beverage, wherein access to this card cavity is from a lower end of a main body of the canteen after a bottom lid of a bottom storage compartment is removed from this lower end; and wherein the bottom storage compartment is of a size and a shape that cannot accommodate removable storage of such cards.

Additionally, it would be desirable if such a hidden bottom storage compartment might be sized and shaped to removably store at least one smartphone in some embodiments.

It is to these ends that the present invention has been developed.

BRIEF SUMMARY OF THE INVENTION

To minimize the limitations in the prior art, and to minimize other limitations that will be apparent upon reading and understanding the present specification, some embodiments, of the present invention may describe a portable canteen with storage compartments, hereinafter, the "canteen." In some embodiments, the canteen may be doubled hulled, formed from an inner cavity and an outer cavity that together function to provide temperature insulation to contents within the inner cavity. In some embodiments, the inner cavity may be a curved inner cavity; and the outer cavity may be a curved outer cavity. In some embodiments, the canteen may comprise a bottom storage cavity which may be formed from a bottom lid that removably connects to a lower end of a main body of the canteen. In some embodiments, this lower end may be an outer lower terminal end of the curved outer cavity. In some embodiments, the bottom cavity may be for removable storage of articles, such as, but not limited to, keys. In some embodiments, from the lower end of the main body (i.e., from the outer lower terminal end of the curved outer cavity) may be an opening to a card cavity. In some embodiments, the card cavity may be shaped and sized to removably hold a predetermined number of cards, such as, but not limited to, credit cards, ATM cards, identification cards (such as a driver's license), and/or the like. In some embodiments, portions of this card cavity may extend upwards into the inner cavity. In some embodiments, the card cavity is not visible from an exterior of the canteen.

In some embodiments, a canteen may comprise a main body. In some embodiments, the main body may comprise two separate and distinct cavities, each of which may function as a storage compartment. In some embodiments, these two different cavities may be a top cavity and a bottom cavity. In some embodiments, these two different cavities may be longitudinally disposed of each other, such that a bottom portion of the top cavity is in disposed above a roof portion of the bottom cavity. In some embodiments, a volume of the bottom cavity may extend, at least partially, into a volume of the top cavity in a manner that is radially symmetrical about a shared central longitudinal axis of both the top cavity and the bottom cavity; and in a manner where these two different volumes remained sealed from each other. In some embodiments, this bottom cavity may be hidden from exterior view of the canteen.

It is an objective of the present invention to provide a beverage drinking canteen and/or a beverage storage canteen.

It is another objective of the present invention to provide a beverage canteen with insulating properties, to minimize heat transfer from or to the beverage (or soup) being removably held within the canteen.

It is another objective of the present invention to provide a beverage canteen with insulating properties wherein these insulating properties derive from a double walled or double hulled construction of the canteen.

It is another objective of the present invention to provide a beverage canteen with at least two different storage compartments, that in addition to an inner cavity that removably stores the beverage.

It is another objective of the present invention to provide a beverage canteen with a bottom storage compartment.

It is another objective of the present invention to provide a beverage canteen with a bottom storage compartment that is formed, at least in part, from a bottom lid that is removably attachable to a lower end of a main body of the canteen.

It is another objective of the present invention to provide a beverage canteen with a bottom storage compartment for removable storage of articles such as, but not limited to, keys.

It is another objective of the present invention to provide a beverage canteen with a card cavity, an insert, and/or a bottom cavity for removable storage of cards such as, but not limited to, credit cards, ATM cards, identification cards (such as a driver's license), social security cards, insurance cards, membership cards, business cards, and/or the like.

It is another objective of the present invention to provide a beverage canteen with a bottom cavity sized and shaped to removably store at least one smartphone within that bottom cavity.

It is another objective of the present invention to provide a beverage canteen with a card cavity, insert, and/or bottom cavity that is not visible from an exterior of the canteen.

It is another objective of the present invention to provide a beverage canteen with a card cavity, insert, and/or bottom cavity that is only accessible by removal of a bottom lid of the given canteen.

It is yet another objective of the present invention to provide a canteen that easily and relatively affordably manufactured from one or more of stainless steel, thermoformed plastics, and/or elastomers.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 2 is also a longitudinal cross-sectional view of the canteen of FIG. 1.

REFERENCE NUMERAL SCHEDULE

Figure 1:
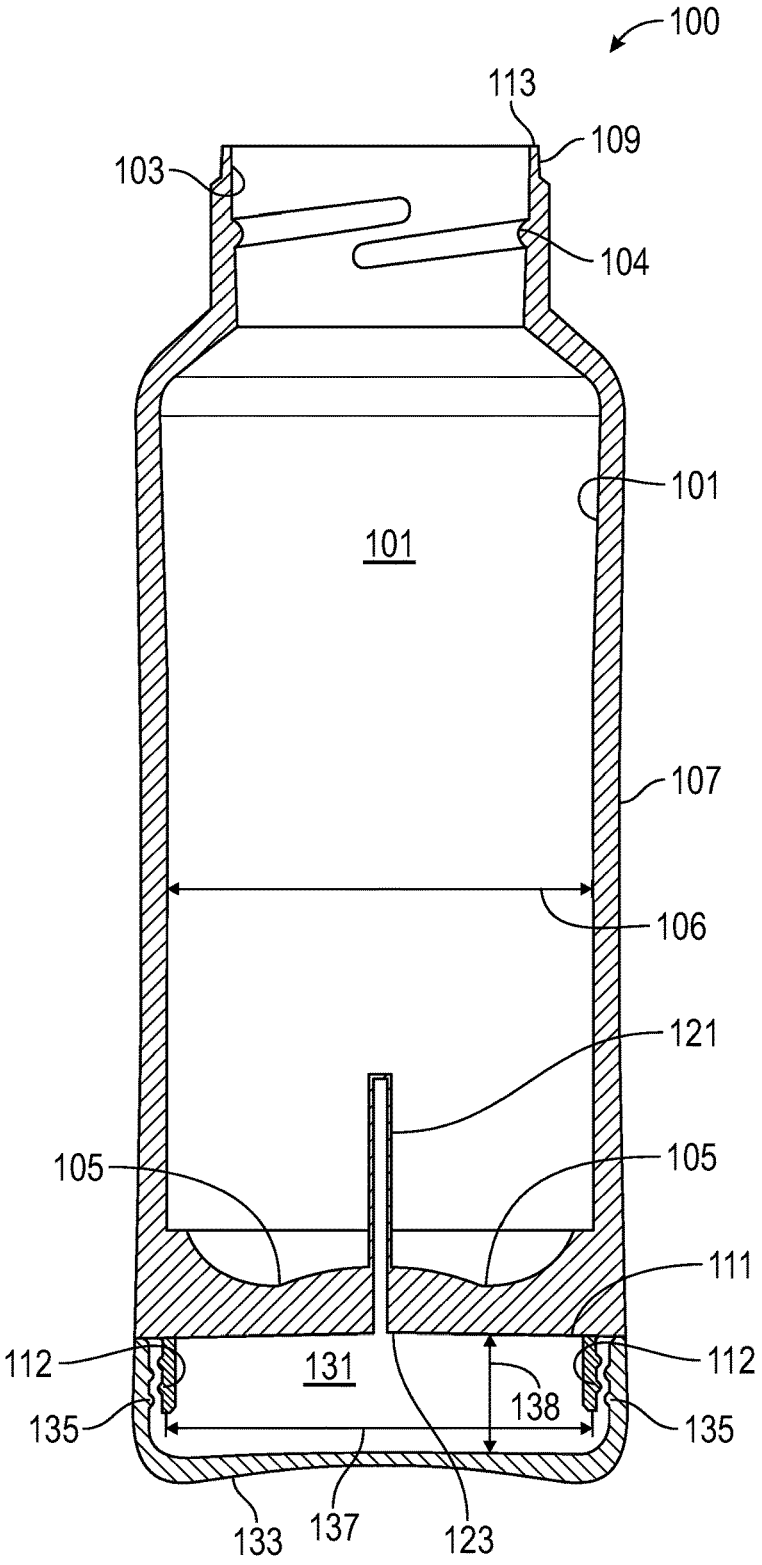
FIG. 1 may depict a portable canteen with storage compartments (hereinafter, the "canteen") from a longitudinal cross-sectional view, with respect to a longitude (length) of the canteen.

100 canteen 100
101 curved inner cavity 101
103 upper receiving end 103
104 threading 104
105 lower terminal end 105
106 inside diameter 106
107 curved outer cavity 107
109 outer upper receiving end 109
111 outer lower terminal end 111
112 threading 112
113 union 113
121 card cavity 121
123 opening 123
131 bottom storage cavity 131
133 bottom lid 133
135 complimentary threading 135
137 inside diameter 137
138 lid height 138
407 outer exterior surface 407
503 top lid 503
504 complimentary threading 504
507 main body 507
700 canteen 700
705 mating surface 705
721 insert 721
800 canteen 800
801 main body 801
803 top cavity 803
807 volume 807
809 top length 809
811 top major diameter 811
813 top interior surface 813
815 top opening 815
817 threading 817
833 bottom cavity 833
835 roof portion 835
837 volume 837
839 bottom length 839
849 bottom major diameter 849
851 bottom interior surface 851
853 bottom opening 853
855 threading 855
865 shared central longitudinal axis 865
871 exterior surface 871
881 bottom lid 881
882 flat planar portion 882
895 top lid 895
896 handle portion 896
1600 insert 1600
1601 cylindrically shaped cup portion 1601
1603 outside diameter 1603
1611 bottom portion 1611
1621 pair of gripping arms 1621
1631 slot 1631
1632 opposing teeth 1632
1700 canteen 1700
1701 main body 1701
1703 top cavity 1703
1705 bottom portion 1705
1707 volume 1707
1709 top length 1709
1711 top major diameter 1711
1713 top interior surface 1713
1715 top opening 1715
1717 top threading 1717
1733 bottom cavity 1733
1735 roof portion 1735
1737 volume 1737
1739 bottom length 1739
1741 nipple region 1741
1743 nipple height 1743
1745 taper 1745
1747 bottom minor diameter 1747
1749 bottom major diameter 1749
1751 bottom interior surface 1751
1753 bottom opening 1753
1755 bottom threading 1755
1765 shared central longitudinal axis 1765
1771 exterior surface 1771
1781 short bottom lid 1781
1783 short lid length 1783
1791 long bottom lid 1791
1793 long lid length 1793
9991 credit card 9991
9995 smartphone 9995

DETAILED DESCRIPTION OF THE INVENTION

Various embodiments of portable (mobile) canteens with storage compartments are described herein. Such portable (mobile) canteens with storage compartments may be referred to as "canteens" or "canteen" herein. Structures of such canteens have been given names with structural and/or functional language for the name to assist is conveying meaning of what such structures may be for.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

FIG. 1 may depict a portable canteen with storage compartments 100 (hereinafter, the "canteen 100") from a longitudinal cross-sectional view, with respect to a longitude of canteen 100.

In some embodiments, canteen 100 may comprise: a curved inner cavity 101, a curved outer cavity 107, a union 113, a card cavity 121, and a bottom storage cavity 131. See e.g., FIG. 1 (and see FIG. 2).

In some embodiments, curved inner cavity 101 may be a substantially physical continuous surface that defines a major volume of canteen 100 that is typically for removable storage of a given liquid. That is, in some embodiments, curved inner cavity 101 may be an inner hull of canteen 100. In some embodiments, curved inner cavity 101 may be elongate. In some embodiments, curved inner cavity 101 may have opposing ends, an upper receiving end 103 that is openable and a lower terminal end 105 that is sealed. In some embodiments, elongate portions of curved inner cavity 101 may be sidewalls to the major volume that curved inner cavity 101 may substantially circumscribe. In some embodiments, lower terminal end 105 may be substantially a closed bottom of the major volume that curved inner cavity 101 may substantially circumscribe. In some embodiments, upper receiving end 103 may be how the given liquid accesses the major volume that curved inner cavity 101 may substantially circumscribe. And the orientation terms of "upper" and "lower" may be with respect to a substrate that canteen 100 may be resting upon while canteen 100 may in an upright position, such that a lower end of canteen 100 may be closer to this substrate and the upper end of canteen 100 may be directly opposed and further away from this substrate. See e.g., FIG. 1 (and see FIG. 2).

In some embodiments, curved outer cavity 107 may be an outer hull of canteen 100. In some embodiments, curved outer cavity 107 may be positioned to substantially enclose all of curved inner cavity 101 except, upper receiving end 103. In some embodiments, curved outer cavity 107 may be elongate. In some embodiments, curved outer cavity 107 may have a shape that is complimentary to and generally mimicking an outer shape of curved inner cavity 101. In some embodiments, the shape of curved outer cavity 107 may substantially conform to the outer shape of curved inner cavity 101. In some embodiments, curved outer cavity 107 may comprise opposing ends, different from the opposing ends of upper inner cavity 103. Curved outer cavity 107 opposing ends may be an outer upper receiving end 109 that is sealed and an outer lower terminal end 111 that is also sealed. See e.g., FIG. 1 (and see FIG. 2).

In some embodiments, union 113 may be where upper receiving end 103 of curved inner cavity 101 and outer upper receiving end 109 of curved outer cavity 107 meet. See e.g., FIG. 1 (and see FIG. 2).

In some embodiments, disposed between curved inner cavity 101 and curved outer cavity 107 may form a double hulled bottle structure. This double hull structure may provide both rigidity structure to canteen 100 and may provide for insulating the liquid being removably held within curved inner cavity 101. In some embodiments, a space or a volume disposed between curved inner cavity 101 and curved outer cavity 107 may be sealed. In some embodiments, disposed between curved inner cavity 101 and curved outer cavity 107 is an insulator. In some embodiments, this insulator may be one or more of: vacuum, near vacuum, air, a gas, a liquid, a gel, a foam, an elastomer, and/or a plastic.

In some embodiments, card cavity 121 may be shaped as a rectangular prism. In some embodiments, card cavity 121 may be sized to removably receive a predetermined number of cards. In some embodiments, card cavity 121 may be shaped as a rectangular prism with a hollow interior portion that is sized to removably receive a predetermined number of cards. In some embodiments, such cards may be selected from one or more of: a credit card, a ATM card, an identification card, a driver's license, a business card, a health insurance card, a membership card, a discount card, a coupon card, a social security card, and/or the like. For example, and without limiting the scope of the present invention, in some embodiments, card cavity 121 may be sized to hold either one, two, three, four, five, or six such cards. For example, and without limiting the scope of the present invention, in some embodiments, card cavity 121 may be sized to hold from one to twelve such cards. In some embodiments, sizing of card cavity 121 may be such that held cards may be held in place via friction.

In some embodiments, card cavity 121 may be positioned to be substantially enclosed by both curved inner cavity 101 and curved outer cavity 107. In some embodiments, portions of card cavity 121 may extend into curved inner cavity 101. In some embodiments, card cavity 121 may comprise a single opening, that of opening 123. In some embodiments, opening 123 is an access area (region) to a volume of card cavity 121. In some embodiments, opening 123 may originate from a portion of outer lower terminal end 111 of curved outer cavity 107. In some embodiments, card cavity 121 may bisect lower terminal end 105 of curved inner cavity 101 extending into curved inner cavity 101 without compromising sealed integrity of the lower terminal end 105. See e.g., FIG. 1 (and see FIG. 2).

In some embodiments, card cavity 121 may have a length that is less than a length of the given card removably held within the card cavity 121, such that a portion of the card protrudes into bottom storage cavity 131. This sizing may facilitate a user inserting or removing the card from card cavity 121 because the portion of the card that protrudes into bottom storage cavity 131 may be gripped by a user of canteen 100. For example, and without limiting the scope of the present invention, such cards often have a length of about 3.375 inches (8.477 centimeters [cm]); and the length of card cavity 121 may be at or less than 3.125 inches (7.938 cm) in some embodiments. In some embodiments the length of card cavity 121 may be at or less than 3 inches (7.620 cm).

In some embodiments, bottom storage cavity 131 may another storage compartment of canteen 100. In some embodiments, canteen 100 may then have three main storage compartments, that of curved inner cavity 101, that of card cavity 121, and that of bottom storage cavity 131. In some embodiments, bottom storage cavity 131 may be located at a bottom of canteen 100, i.e., at canteen 100's lower end. In some embodiments, bottom storage cavity 131 may be formed from a bottom lid 133 that is removable from a main body 507 of canteen 100. (See FIG. 5 for main body 507.) In some embodiments, bottom lid 133 may attach beneath and at or proximate to outer lower terminal end 111. See e.g., FIG. 1 (and see FIG. 2).

In some embodiments, threading 112 may extend downwards from a bottom of outer lower terminal end 111. In some embodiments, this threading 112 may forms sidewalls of bottom storage cavity 131. In some embodiments, outer lower terminal end 111 may substantially form a ceiling to bottom storage cavity 131. In some embodiments, bottom lid 133 may form a floor to bottom storage cavity 131. In some embodiments, bottom lid 133 may comprise complimentary threading 135 that may removably mate with the threading 112 for a purpose of removably securing bottom lid 133 to outer lower terminal end 111 so as to form bottom storage cavity 131. See e.g., FIG. 1 (and see FIG. 2).

In some embodiments, an inside diameter 137 of bottom storage cavity 131 may be substantially the same as an inside diameter 106 of curved inner cavity 101. In some embodiments, inside diameter 137 of bottom storage cavity 131 may be longer than inside diameter 106 of curved inner cavity 101. See e.g., FIG. 1 (and see FIG. 2).

For example, and without limiting the scope of the present invention, in some embodiments, inside diameter 137 may be about 74 to 75 millimeters (mm). For example, and without limiting the scope of the present invention, in some embodiments, inside diameter 106 may be about 70 to 71 mm. For example, and without limiting the scope of the present invention, in some embodiments, an inside usable height, i.e., lid height 138, of bottom storage cavity 131 may be about 19 to 20 mm; whereas, an exterior height of bottom storage cavity 131 may be about 23 to 24 mm. Where "about" may be plus or minus 10% of the unit noted. See FIG. 1 for lid height 138 and inside diameter 137.

In some embodiments, a size and a shape of bottom storage cavity 131 may be such that the bottom storage cavity 131 may not accommodate removable storage of the contemplated cards and this may be evident from a perspective of an observer looking upon the exterior of canteen 100. This is important because the observer observing the exterior of canteen 100 would not think that the bottom storage compartment would ever store such cards. In some embodiments, the inside usable height of bottom storage cavity 131 may be less than the length of card cavity 121. In some embodiments, a ratio of the length of card cavity 121 to the inside usable height of bottom storage cavity 131 may be from 3 to 5. In some embodiments, the ratio of the length of card cavity 121 to the inside usable height of bottom storage cavity 131 may be from 3.8 to 4.5.

In some embodiments, an outside diameter of bottom storage cavity 131 may be substantially the same as an outside diameter of curved outer cavity 107. See e.g., FIG. 1 (and see FIG. 2). For example, and without limiting the scope of the present invention, in some embodiments, an outside diameter of canteen 100 may be about 80 to 81 mm.

In some embodiments, bottom storage cavity 131 may be sized to removably receive one or more articles. In some embodiments, the one or more articles may be selected from one or more of: keys, coins, hard currency (i.e., paper currency), food, snacks, USB thumb drive, and/or the like.

Figure 2:
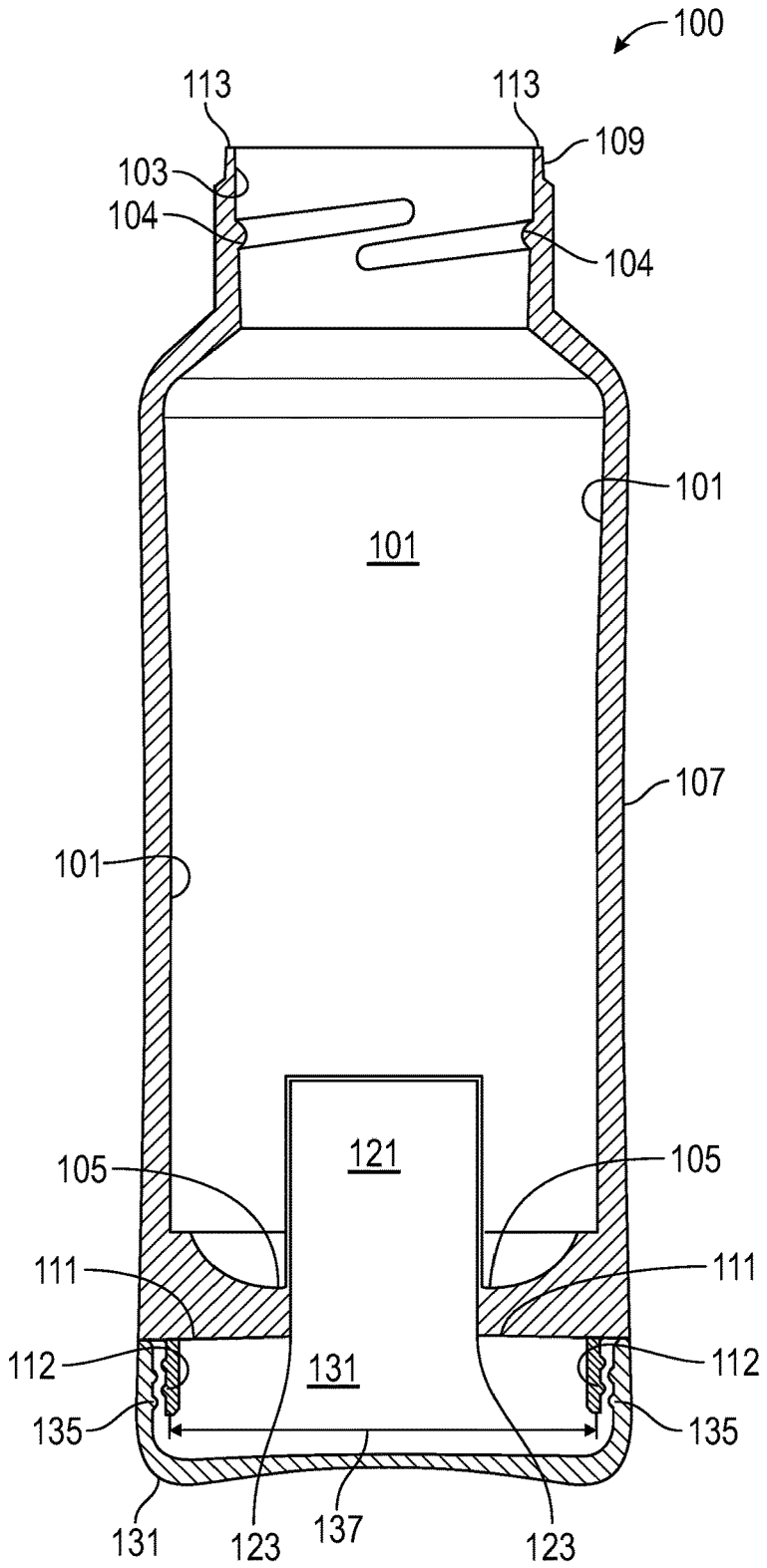
FIG. 2 may depict the canteen of FIG. 1, but wherein this view has been rotated about a central longitudinal access of the canteen by about 90 degrees with respect to FIG. 1.

FIG. 2 may depict canteen 100, but where the view shown has been rotated about a central longitudinal axis of canteen 100 by about 90 degrees with respect to FIG. 1. FIG. 2 is also a longitudinal cross-sectional view. In FIG. 1 a thickness of card cavity 121 may be shown; whereas in FIG. 2, a transverse width of card cavity 121 may be shown. FIG. 2 and FIG. 1 taken together show that card cavity 121 may have a shape of a rectangular prism. Otherwise the structures and features shown in FIG. 1 and in FIG. 2 may be substantially the same due to substantial radial symmetry of canteen 100 (aside e.g., from card cavity 121).

Figure 3:
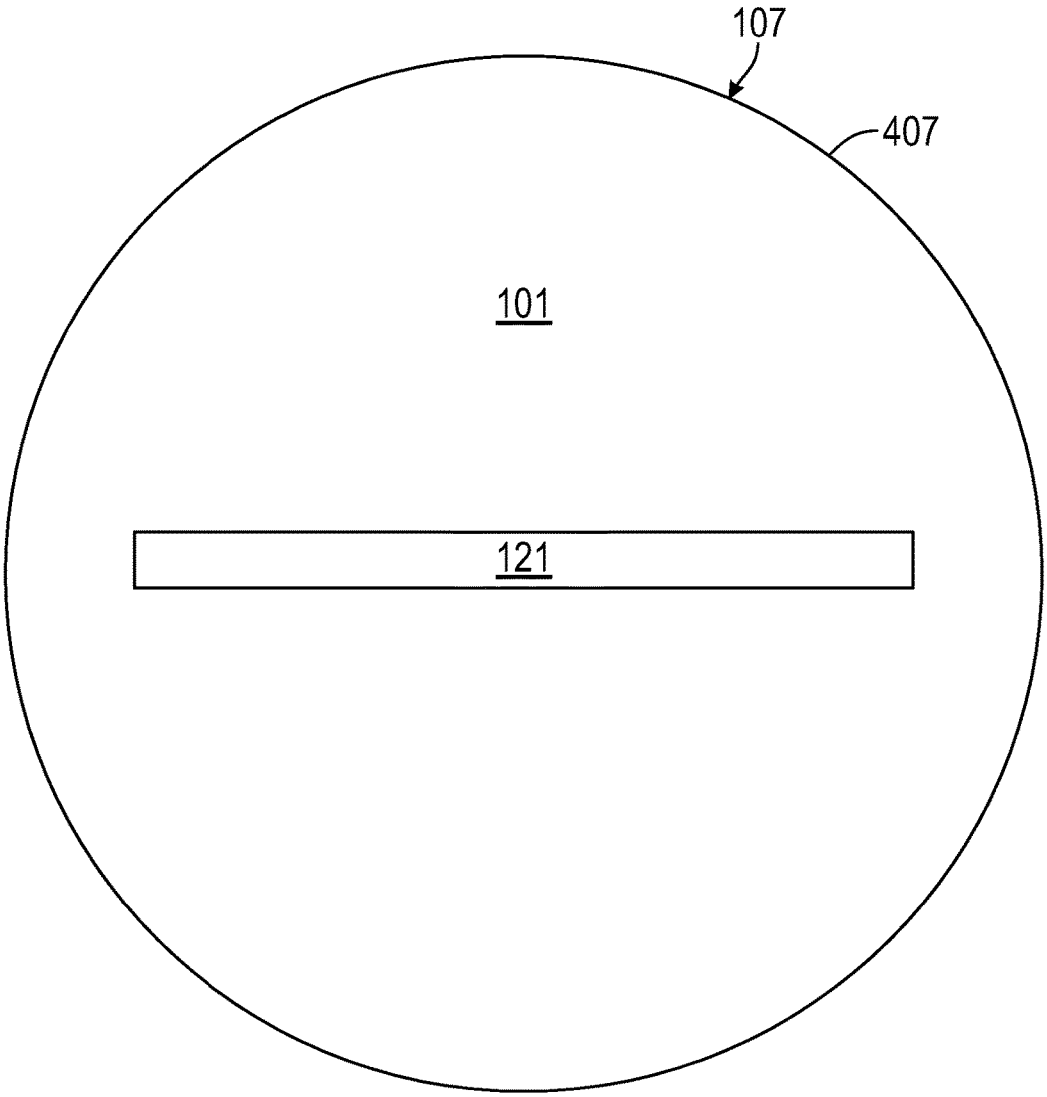
FIG. 3 may depict the canteen of FIG. 1 in a transverse width cross-sectional view, wherein a card cavity within a curved inner cavity of the canteen may be shown.

FIG. 3 may depict canteen 100 in a transverse width cross-sectional view, wherein card cavity 121 within curved inner cavity 101 of canteen 100 may be shown. In FIG. 3, both the thickness and the transverse width of card cavity 121 are shown, which along with FIG. 1 and FIG. 2 show the rectangular prism shape of card cavity 121. FIG. 3 also shows substantial portions of card cavity 121 being located within the major volume of curved inner cavity 101. FIG. 3 also shows the otherwise radial symmetry of canteen 100.

Figure 4:
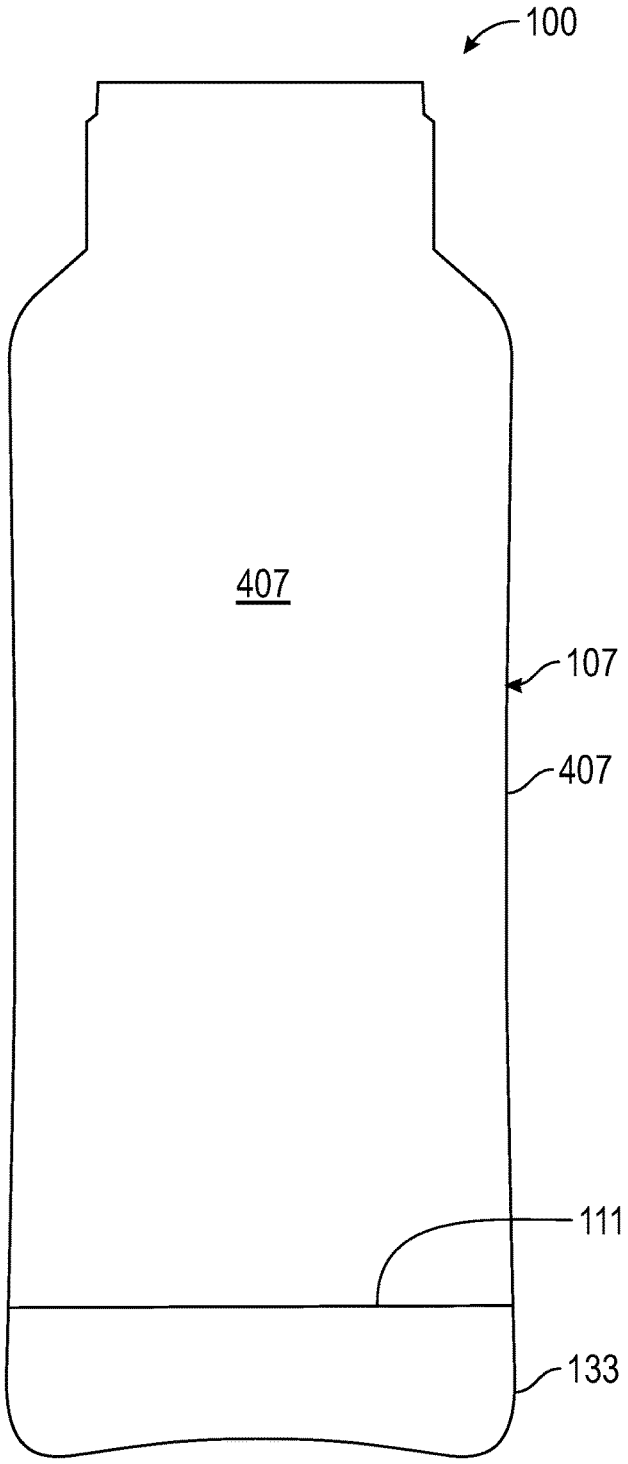
FIG. 4 may depict the canteen of FIG. 1 shown from a longitudinal side view.

FIG. 4 may depict canteen 100, shown from a longitudinal side view. In FIG. 4 outer exterior surface 407 may be seen. In some embodiments, outer exterior surface 407 may be the exterior portions of curved outer cavity 107. That is, in some embodiments, curved outer cavity 107 may comprise outer exterior surface 407.

Figure 5:
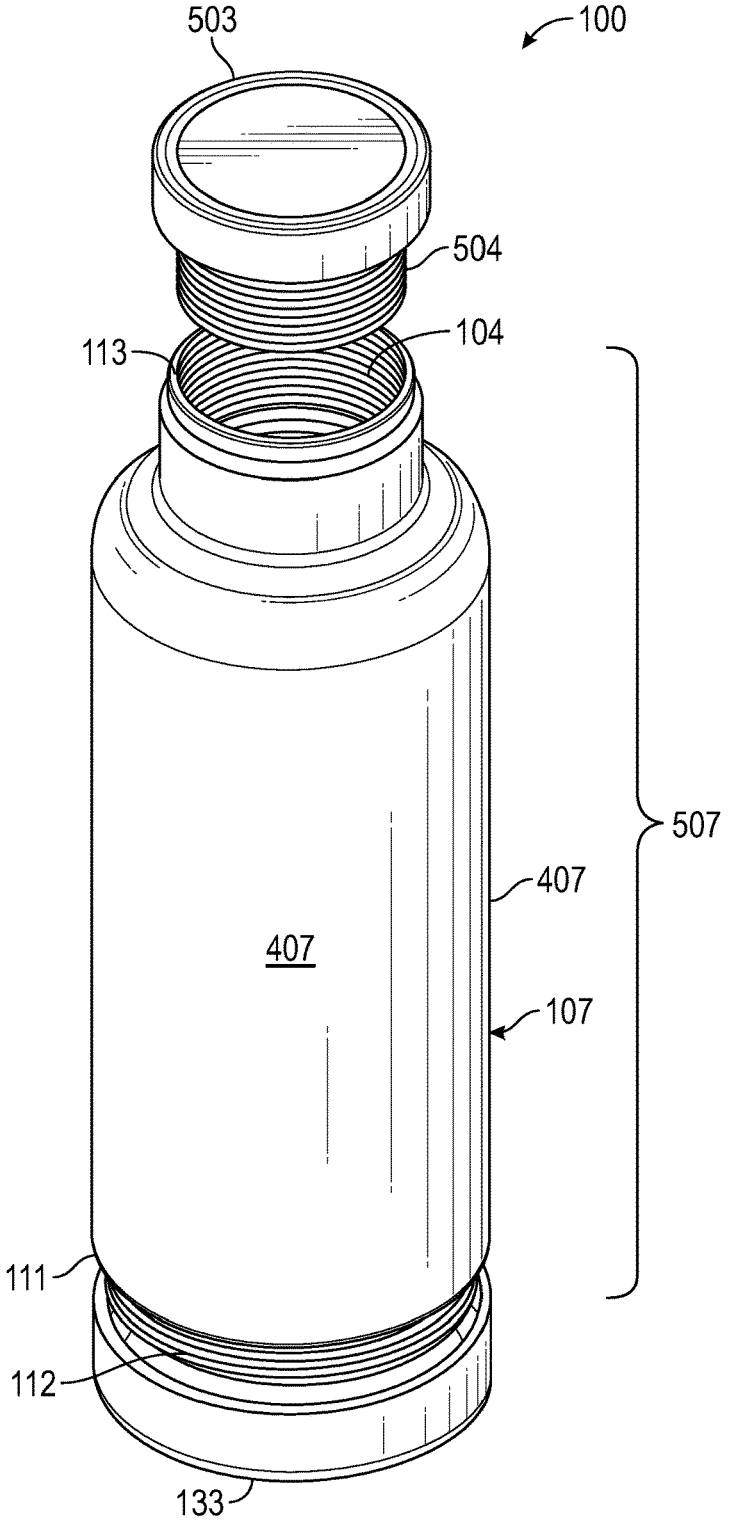
FIG. 5 may depict the canteen of FIG. 1, in an exploded perspective view, with a top lid and a bottom lid exploded away from a main body portion of the canteen.

FIG. 5 may depict canteen 100, in an exploded perspective view, with a top lid 503 and bottom lid 133 exploded away from main body 507 portion of canteen 100. In some embodiments, main body 507 may a portion of canteen 100 that runs from union 113 at a top to outer lower terminal end 111 towards the bottom of canteen 100. See e.g., FIG. 5.

In some embodiments, canteen 100 comprises top lid 503. In some embodiments, top lid 503 may be removable from main body 113. In some embodiments, top lid 503 may be what removably closes and/or seals upper receiving end 103. In some embodiments, top lid 503 may be what keeps the liquid removably held within the major volume of curved inner cavity 101 from leaking and/or spilling out. In some embodiments, at or proximate to upper receiving end 103 is threading 104. In some embodiments, top lid 503 has complimentary threading 504. In some embodiments, top lid 503 may be removably screwed into upper receiving end 103 via threading 104 removably mating with complimentary threading 504. See e.g., FIG. 5. In some embodiments, threading 104 may be female threading and complimentary threading 504 may be male threading.

In some embodiments, at or proximate to outer upper receiving end 109 (see FIG. 1 or FIG. 2 for outer upper receiving end 109) may be threading (e.g., male threading) and a top lid may have complimentary threading (e.g., female threading); such that the top lid may be removably screwed onto outer upper receiving end 109 via the threading removably mating with the complimentary threading. Note, this threading and complimentary threading arrangement embodiment is not depicted in the figures.

Figure 6:
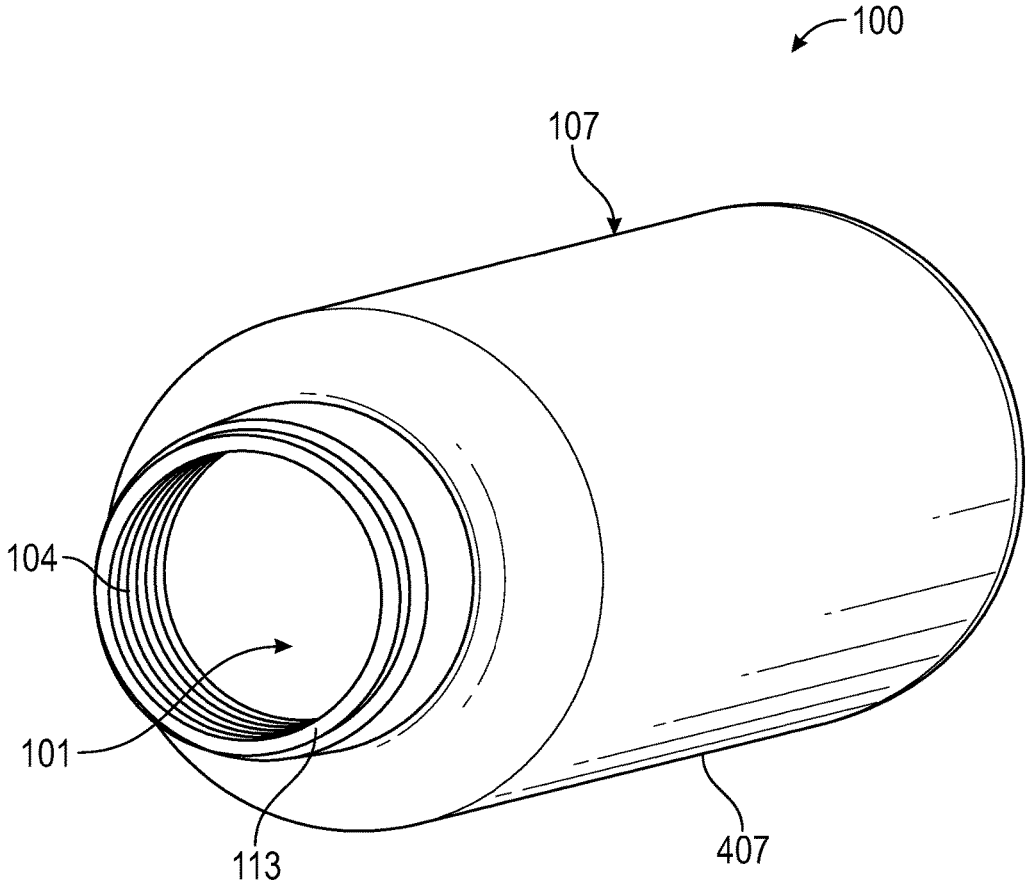
FIG. 6 may depict the canteen from a top perspective view with the lop lid removed.

FIG. 6 may depict canteen 100 from a top perspective view with lop lid 503 removed. In FIG. 6, portions of outer exterior surface 407 of curved outer cavity 107, union 113, portions of curved inner cavity 101, and threading 104 may be seen.

Figure 7:
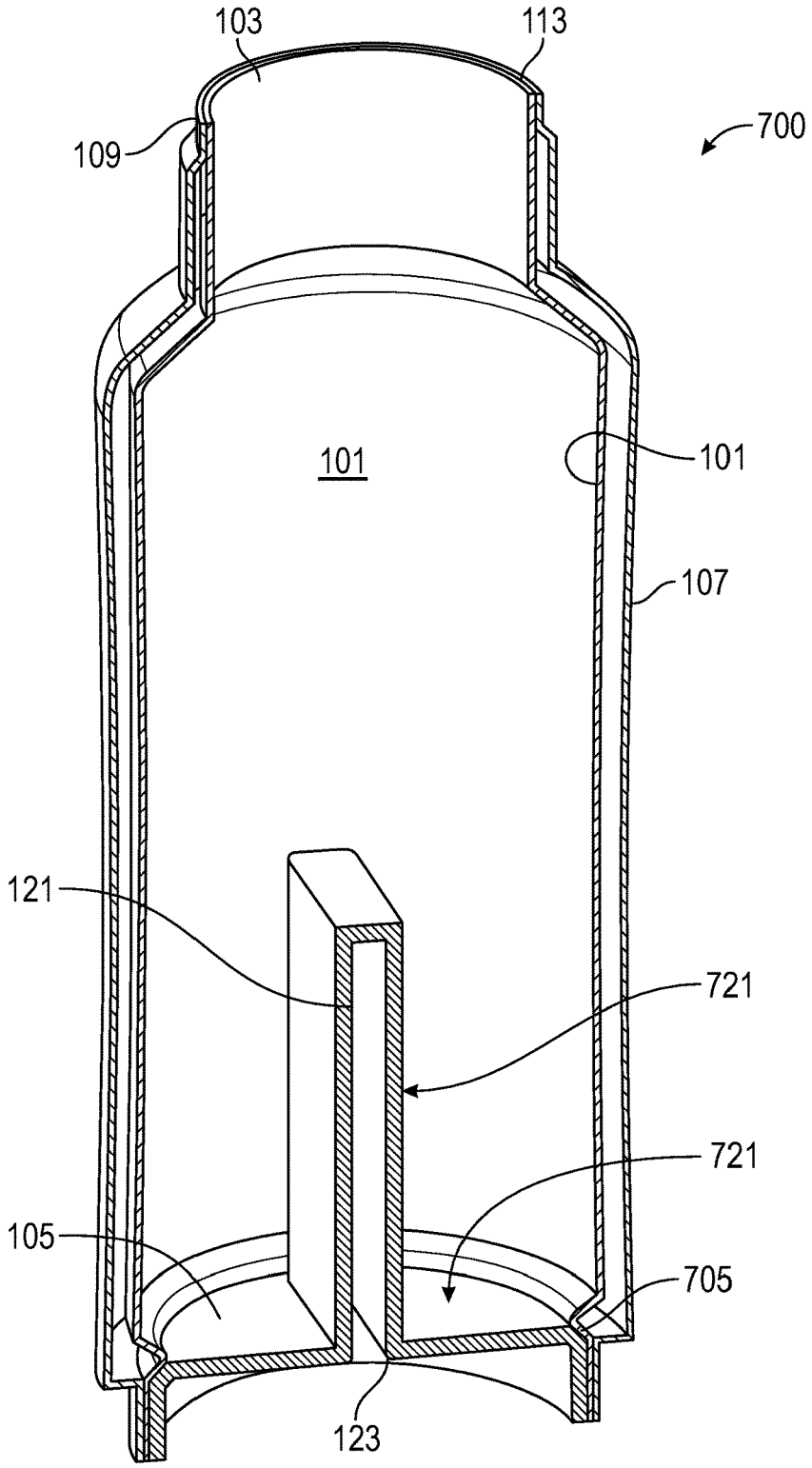
FIG. 7 may depict a canteen with storage compartments from a longitudinal cross-sectional perspective view, with respect to a longitude of the canteen.

FIG. 7 may depict a portable canteen with storage compartments 700 (hereinafter, the "canteen 700") from a longitudinal cross-sectional perspective view, with respect to a longitude of canteen 700.

In some embodiments, canteen 700 may comprise: curved inner cavity 101, curved outer cavity 107, union 113, card cavity 121, and bottom storage cavity 131. See e.g., FIG. 7. In some embodiments, curved inner cavity 101, curved outer cavity 107, union 113, card cavity 121, and bottom storage cavity 131 may be discussed above, except that in canteen 700, card cavity 121 and lower terminal end 105 may be integral with each other and formed from insert 721. In some embodiments, canteen 700 may also comprise insert 721. In some embodiments, insert 721 may comprise card cavity 121 and lower terminal end 105. In some embodiments, lower terminal end 105 of insert 721 may be a substantially circular disk shaped region of insert 721 and card cavity 121 may be a hollow rectangular prism portion of insert 721 that may extend in a direction that is substantially perpendicular from major surfaces of the circular disk region. See FIG. 7.

In some embodiments, insert 721 may attach to the bottom of curved inner cavity 101, that such portions of card cavity 121 extend upwards into curved inner cavity 101 and that lower terminal end 105 forms the lower terminal end of curved inner cavity 101. In some embodiments, a location of such attachment may be at mating surface 705, wherein curved inner cavity 101 may comprise mating surface 705. In some embodiments, mating surface 705 of curved inner cavity 101 may be located at or proximate to the bottom of curved inner cavity 101. In some embodiments, a nature of such attachment between insert 721 and mating surface 705 may be permanent. In some embodiments, the nature of such attachment between insert 721 and mating surface 705 may be removable. In some embodiments, the nature of attachment between insert 721 and mating surface 705 may be formed from one or more of: mechanical fasteners (e.g., threading and/or friction press fits [e.g., crimping]), chemical adhesive, heat welding, ultrasonic welding, solvent bonding, and/or the like. See e.g., FIG. 7.

Figure 8:
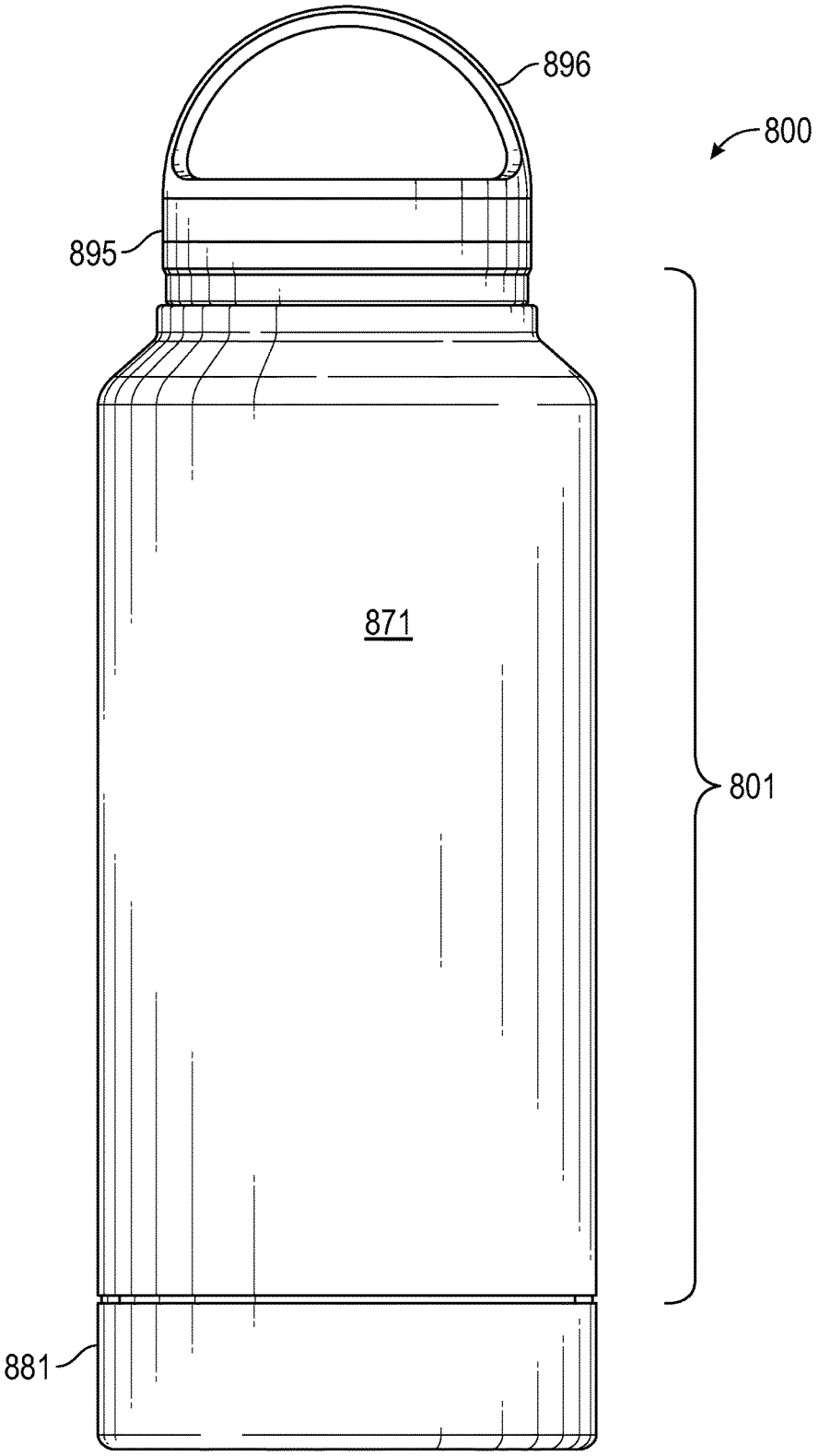
FIG. 8 may depict an embodiment of a canteen with storage compartments, shown from a longitudinal side view.

FIG. 8 may depict an embodiment of a canteen 800 with storage compartments (e.g., a top cavity 803 and a bottom cavity 833), shown from a longitudinal side view. Note, these storage compartments (e.g., top cavity 803 and bottom cavity 833) may not be shown in FIG. 8; rather, see FIG. 14 and FIG. 15 for these storage compartments. FIG. 8 may show an assembled and exterior view of canteen 800. In some embodiments, canteen 800 may comprise main body 801, top lid 895, and bottom lid 881. In some embodiments, main body 801 may have exterior surface 871. In some embodiments, top lid 895 may removably attach to a top portion of main body 801. In some embodiments, top lid 985 may comprise a handle portion 896, which may be a closed loop structure. In some embodiments, bottom lid 881 may removably attach to a bottom portion of main body 801. A bottom portion of bottom lid 881 may be substantially flat, permitting canteen 800 to rest in an upward position upon some given substrate, such as, but not limited to, a table top, floor, counter top, desk, and/or the like.

Figure 9:
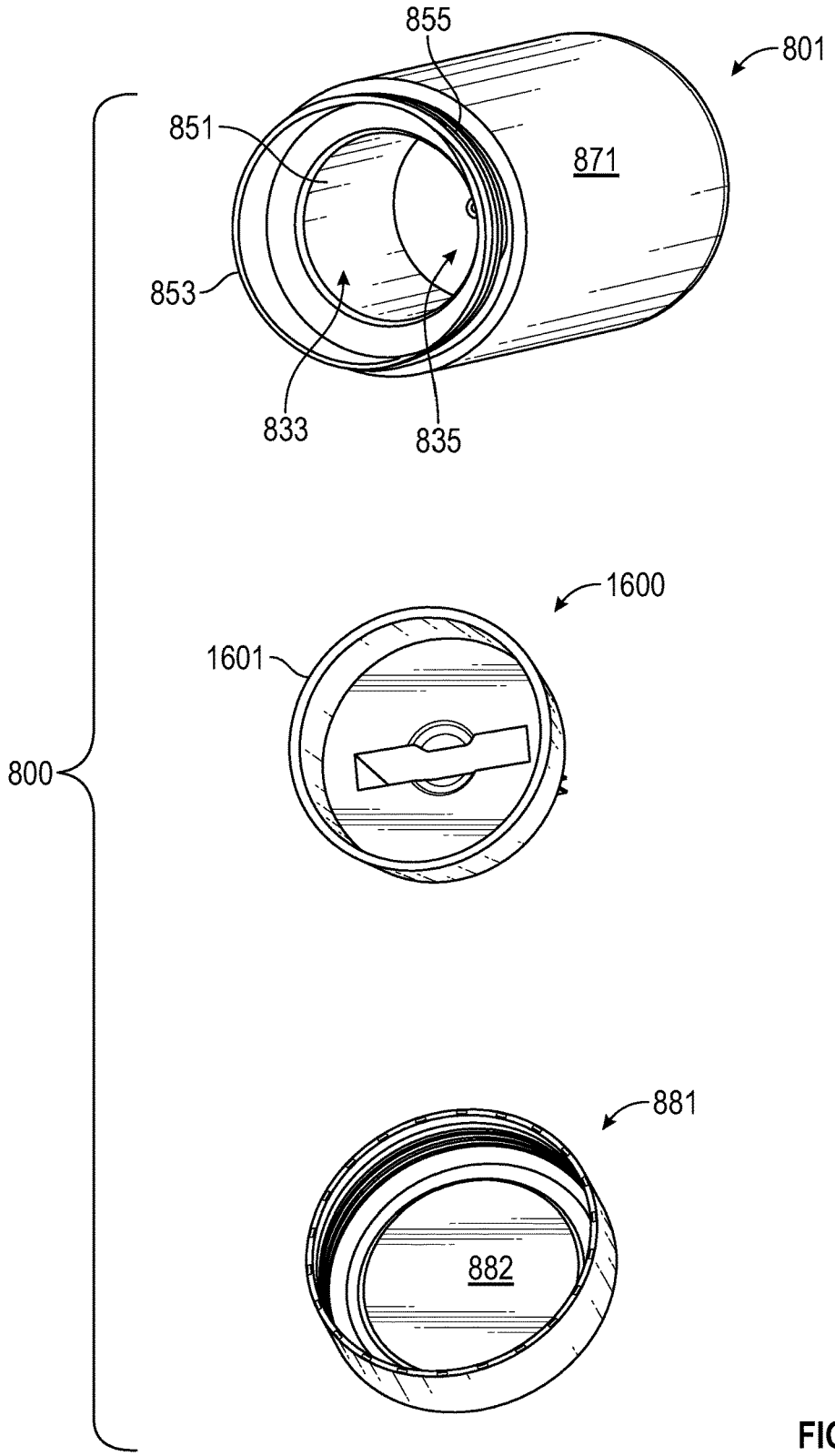
FIG. 9 may depict an exploded perspective view of the canteen from FIG. 8.

FIG. 9 may depict an exploded perspective view of canteen 800. In FIG. 9, main body 801 may be shown exploded away from an insert 1600 and away from bottom lid 881. In FIG. 8, at least a portion of bottom cavity 833 may be visible. In some embodiments, insert 1600 may be insertable into bottom cavity 833. In some embodiments, insert 1600 may removably grip at least one credit card 9991 (and/or similar shaped and sized objects). Insert 1600 may be shown further in FIG. 16A, FIG. 16B, FIG. 16C, and FIG. 16D; and discussed further in the discussion of those figures below.

Continuing discussing FIG. 9, in some embodiments, bottom cavity 833 may comprise bottom interior surface 851 and roof portion 835. In some embodiments, bottom interior surface 851 and roof portion 835 may partially define and bound a volume 837 of bottom cavity 833 (note, volume 837 may be shown in FIG. 14). Access to bottom cavity 833 may be via bottom opening 853. When bottom lid 881 may be attached to the bottom portion of main body 801, then bottom lid 881 may removably seal bottom opening 853. See e.g., FIG. 9.

Continuing discussing FIG. 9, in some embodiments, bottom lid 881 may comprise flat planar portion 882. In some embodiments, bottom lid 881 may comprise two separate components, flat planar portion 882 and a collar portion to receive flat planar portion 882; similar to a lid of a mason style jar.

Figure 10:
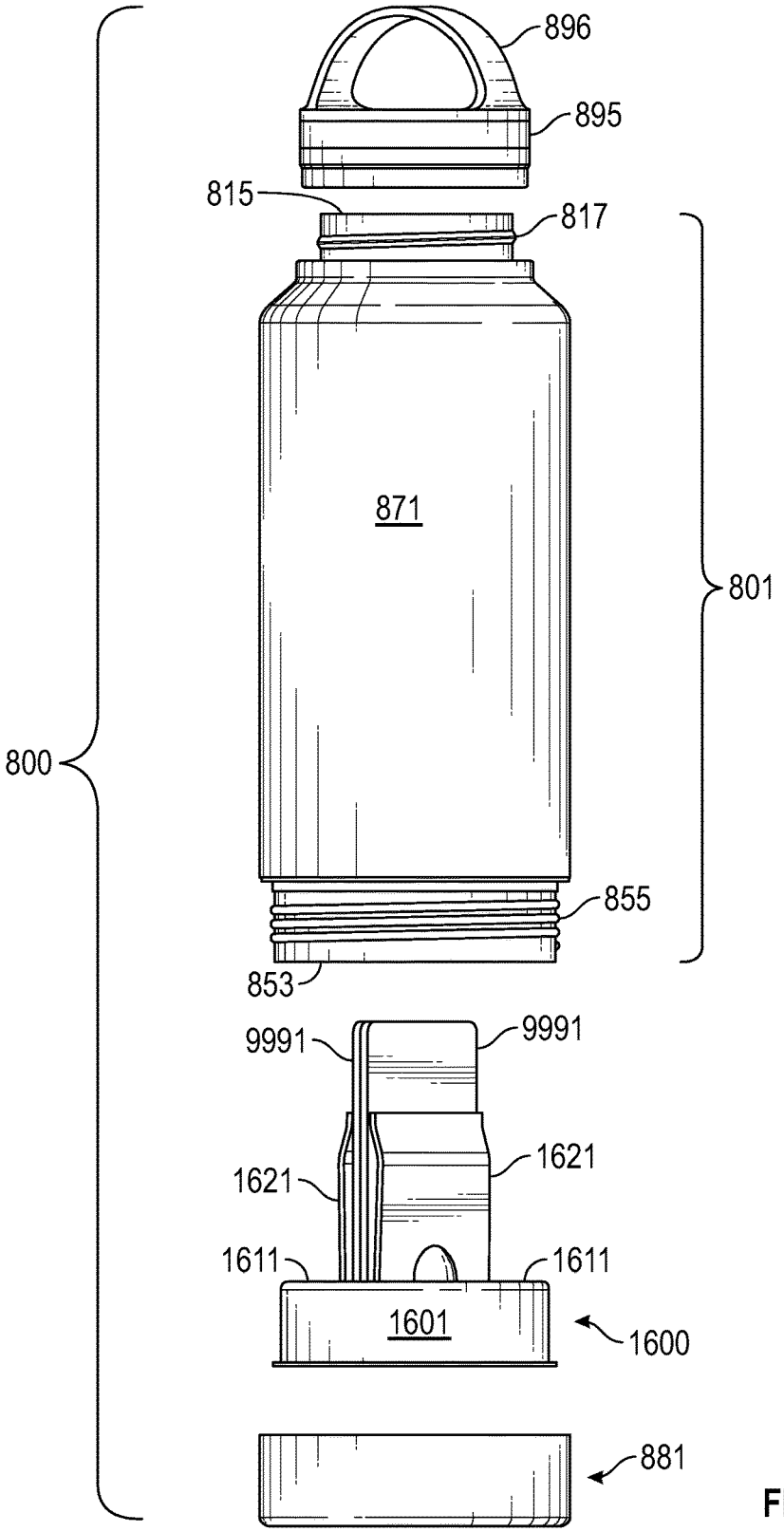
FIG. 10 may depict an exploded longitudinal side view of the canteen from FIG. 8; and showing at least two credit cards which may have been stored within a bottom cavity of the canteen.

FIG. 10 may depict an exploded longitudinal side view of canteen 800; and showing at least two credit cards 9991 which may have been stored within bottom cavity 833. In FIG. 10, main body 801 may be shown exploded away from top lid 895, away from insert 1600 and away from bottom lid 881. In FIG. 10, insert 1600 may be shown removably gripping at least two credit cards 9991 (or similar sized and shaped objects). Some additional structures of main body 801 may be seen in FIG. 10, such as top opening 815 (removably sealable by top lid 895), threading 817 (to be removably coupled with complimentary threading of top lid 895), bottom opening 853 (removably sealable by bottom lid 881), and threading 855 (to be removably coupled with complimentary threading of bottom lid 881).

Figure 11:
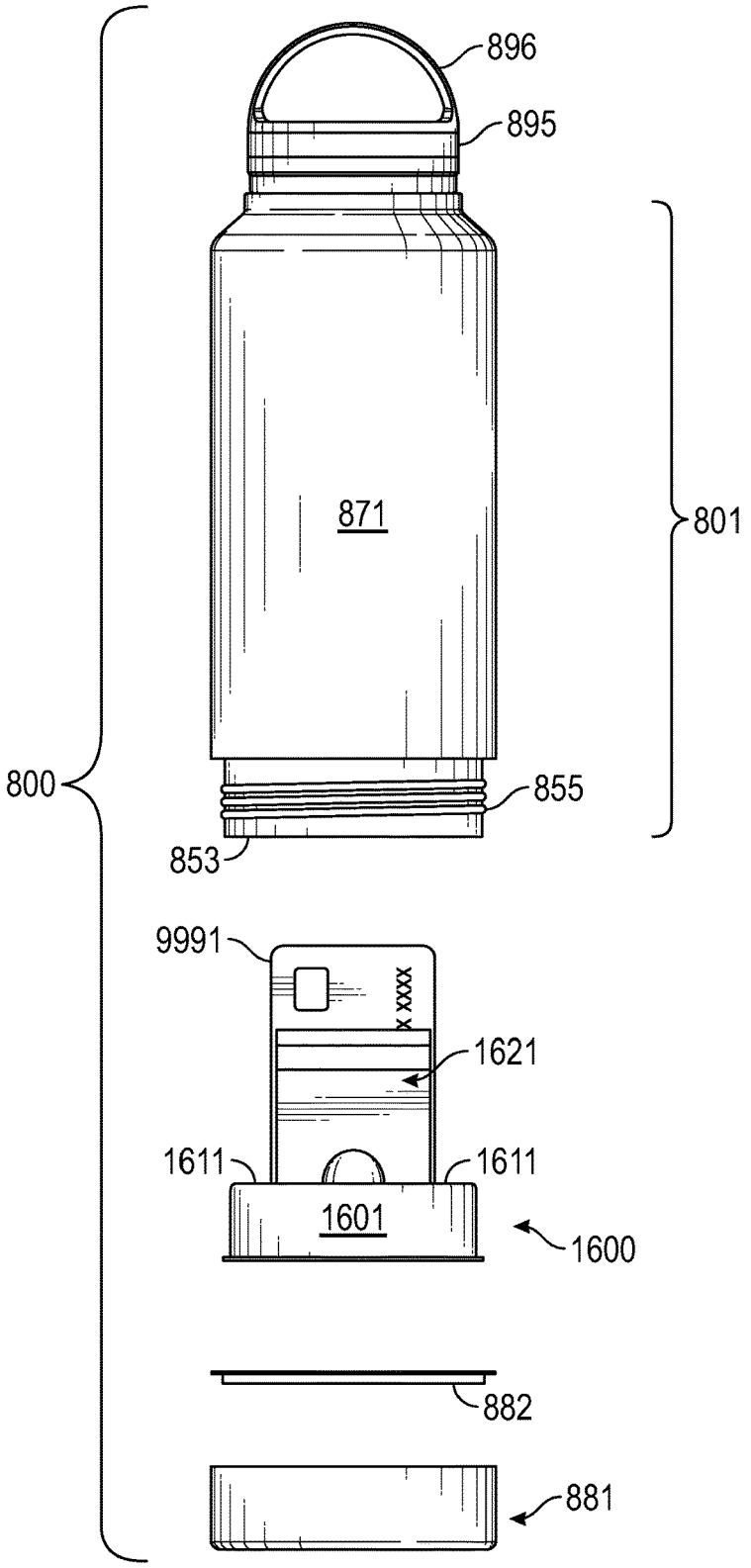
FIG. 11 may depict an exploded longitudinal side view of the canteen from FIG. 8; and showing at least one credit card which may have been stored within the bottom cavity of the canteen.

FIG. 11 may depict an exploded longitudinal side view of canteen 800; and showing at least one credit card 9991 which may have been stored within a bottom cavity 833. In FIG. 11, main body 801 may be shown exploded away from insert 1600 and away from bottom lid 881. In FIG. 11, insert 1600 may be shown removably gripping at least one credit card 9991 (or similar sized and shaped objects). FIG. 10 may also show bottom opening 853 (removably sealable by bottom lid 881) and threading 855 (to be removably coupled with complimentary threading of bottom lid 881). FIG. 11 may also show flat planar portion 882 exploded away from the collar portion of bottom lid 881. Note a viewing angle of FIG. 11 may be rotated as compared to a viewing angle of FIG. 10.

Figure 12:
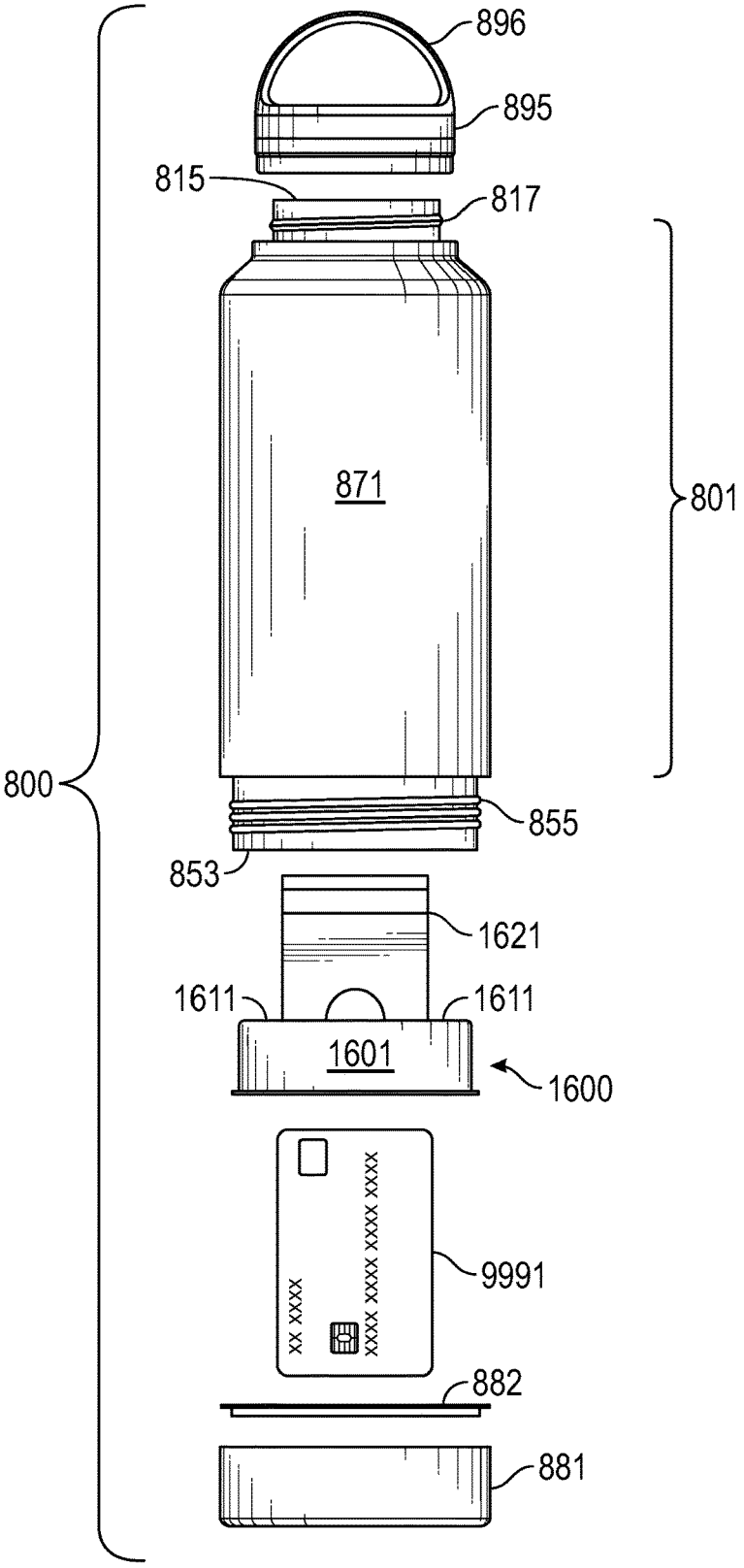
FIG. 12 may depict an exploded longitudinal side view of the canteen from FIG. 8; and showing at least one credit card which may have been stored within the bottom cavity of the canteen.

FIG. 12 may depict an exploded longitudinal side view of canteen 800; and showing at least one credit card 9991 which may have been stored within bottom cavity 833. In FIG. 12, main body 801 may be shown exploded away from top lid 895, away from insert 1600, and away from bottom lid 881. In FIG. 12, insert 1600 may be shown exploded from at least one credit card 9991 (or similar sized and shaped objects). FIG. 12 may also show top opening 815 (removably sealable by top lid 895), threading 817 (to be removably coupled with complimentary threading of top lid 895), bottom opening 853 (removably sealable by bottom lid 881), and threading 855 (to be removably coupled with complimentary threading of bottom lid 881). FIG. 12 may also show flat planar portion 882 exploded away from the collar portion of bottom lid 881. Note a viewing angle of FIG. 12 may be the same as compared to the viewing angle of FIG. 11. FIG. 12 and FIG. 11, may differ in showing the relationship of at least one credit card 9991 to insert 1600; i.e., shown exploded in FIG. 12 and shown removably coupled in FIG. 11.

Note, with respect to credit cards 9991 and similarly sized articles/objects (e.g., ATM/debit cards), a standard sized credit card may be have the following dimensions a length of 3.370 inches (or 85.60 mm) by a width of 2.125 inches (or 53.98 mm). Such standard sized credit cards may be dimensioned in accordance with standard ISO/IEC 7810#ID-1.

Figure 13:
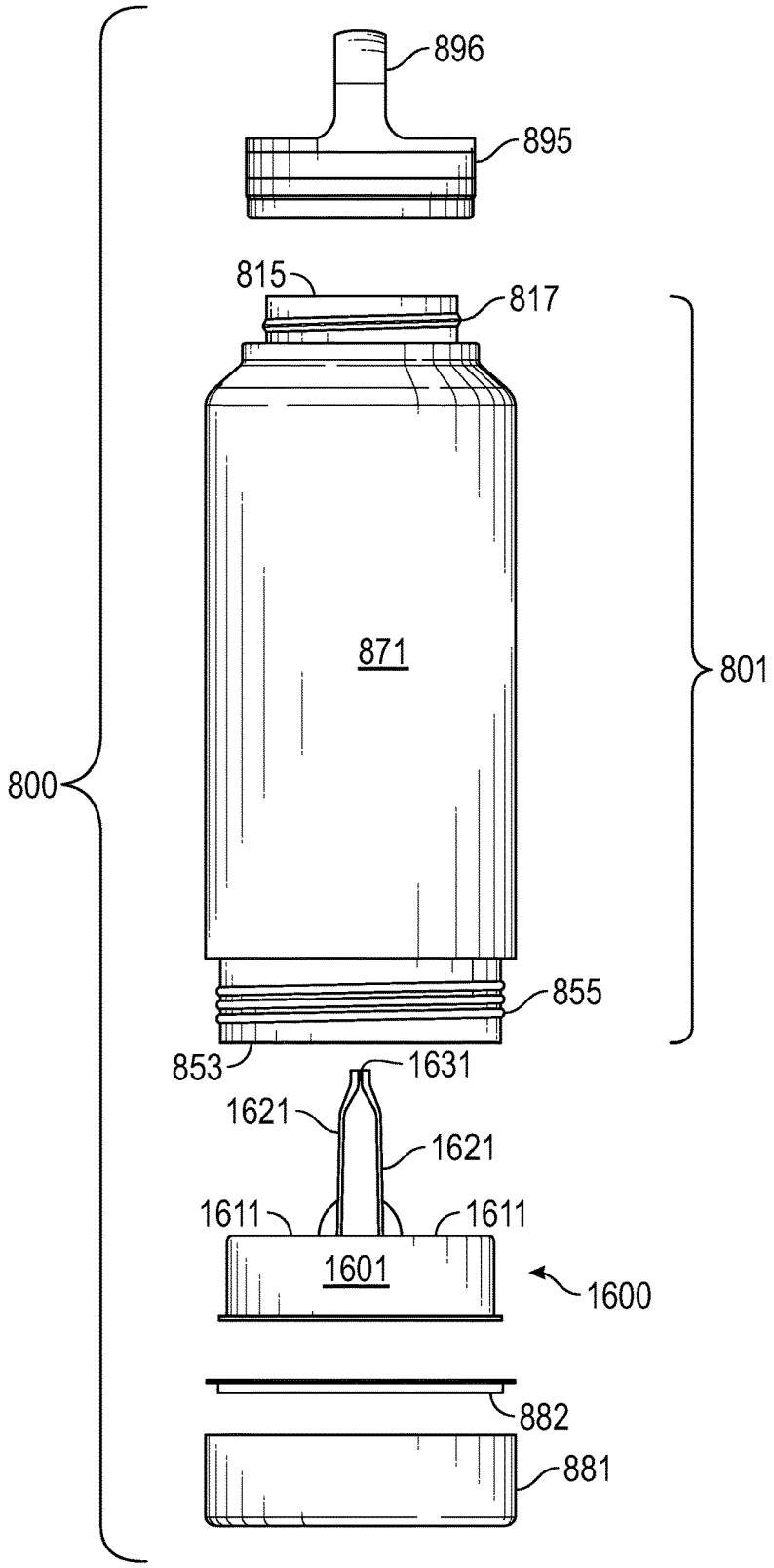
FIG. 13 may depict an exploded longitudinal side view of the canteen from FIG. 8; without showing the at least one credit card.

FIG. 13 may depict an exploded longitudinal side view of canteen 800; without showing the at least one credit card 9991.

In FIG. 13, main body 801 may be shown exploded away from top lid 895, away from insert 1600, and away from bottom lid 881. In FIG. 13, insert 1600 may be shown without showing at least one credit card 9991 (or similar sized and shaped objects). FIG. 13 may also show top opening 815 (removably sealable by top lid 895), threading 817 (to be removably coupled with complimentary threading of top lid 895), bottom opening 853 (removably sealable by bottom lid 881), and threading 855 (to be removably coupled with complimentary threading of bottom lid 881). FIG. 13 may also show flat planar portion 882 exploded away from the collar portion of bottom lid 881. Note a viewing angle of FIG. 13 may be rotated by about 90 degrees as compared to the viewing angle of FIG. 12. FIG. 13 and FIG. 12, may differ by FIG. 13 not showing at least one credit card 9991.

Figure 14:
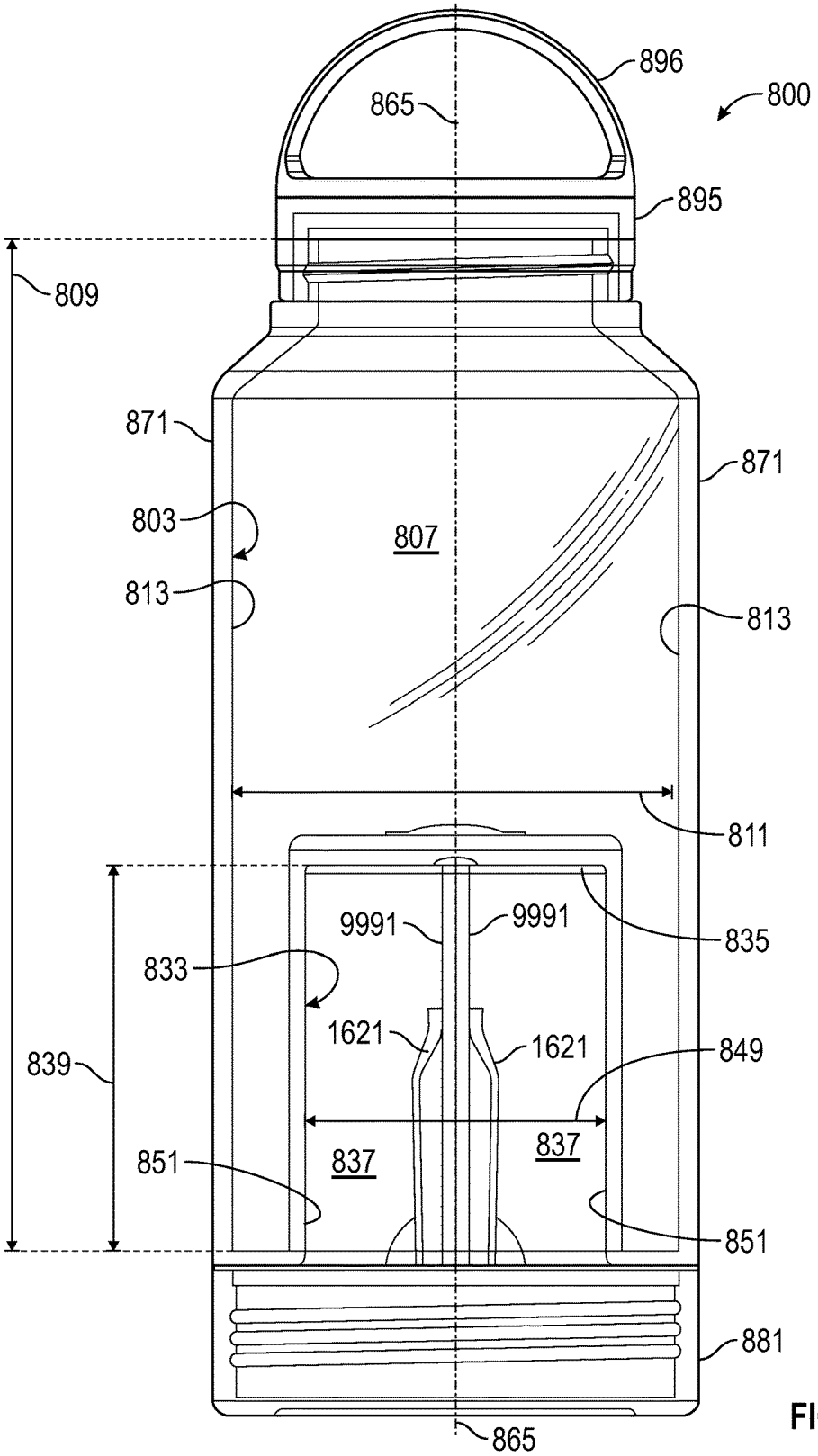
FIG. 14 may depict a cross-sectional longitudinal view of the canteen from FIG. 8, showing interior structures and geometry of this canteen.
Figure 15:
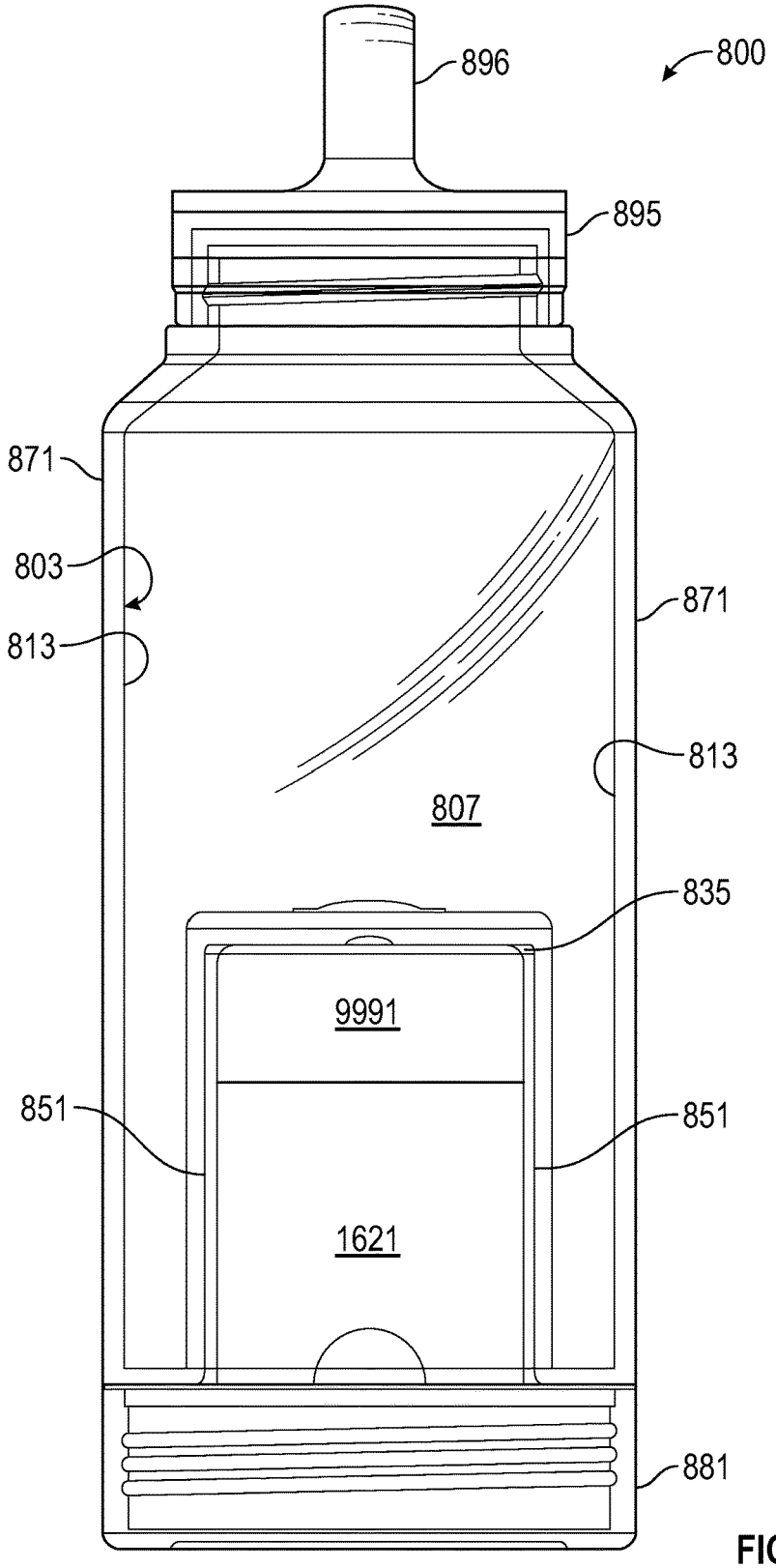
FIG. 15 may depict a cross-sectional longitudinal view of the canteen from FIG. 8, showing interior structures and geometry of this canteen.

FIG. 14 may depict a cross-sectional longitudinal view of canteen 800. FIG. 15 may depict a cross-sectional longitudinal view of canteen 800. FIG. 15 may be rotated by about 90 degrees with respect to a viewing angle of FIG. 14. Because both FIG. 14 and FIG. 15 may be longitudinal cross-sectional views, internal structures and geometry of canteen 800 may be shown in FIG. 14 and in FIG. 15.

In some embodiments, storage compartments of canteen 800 may be two different cavities within canteen 800. In some embodiments, canteen 800 may comprise a main body 801 (see e.g., FIG. 9 and FIG. 10). In some embodiments, main body 801 may be exteriorly substantially shaped as a cylinder. In some embodiments, main body 801 may comprise the two different cavities. In some embodiments, these two different cavities may be a top cavity 803 and a bottom cavity 833. See e.g., FIG. 14 and FIG. 15. In some embodiments, these two different cavities may be concentrically and coaxially disposed of each other, such that bottom cavity 833 may be located within and extend into top cavity 803 in a concentric and coaxial manner; with respect to a shared central longitudinal axis 865. In some embodiments, top cavity 803 may remain sealed and/or isolated from bottom cavity 833, such that contents of top cavity 803 may not physically contact contents of bottom cavity 833. See e.g., FIG. 14 and FIG. 15.

In some embodiments, top cavity 803 may comprise a volume 807. In some embodiments, bottom cavity 833 may comprise a volume 837. In some embodiments, volume 837 of bottom cavity 833 may extend into volume 807 of top cavity 803 in a manner that may be radially symmetrical about shared central longitudinal axis 865 of both top cavity 803 and bottom cavity 833. In some embodiments, top cavity 803 may be radially symmetrical with respect to shared central longitudinal axis 865. In some embodiments, bottom cavity 833 may be radially symmetrical with respect to shared central longitudinal axis 865. In some embodiments, access to top cavity 803 and/or to volume 807 may be via top opening 815. In some embodiments, top opening 815 may be located a top of main body 801. In some embodiments, at and/or proximate to top opening 815 may be threading 817. In some embodiments, threading 817 may removably couple to complimentary threading located on a top lid (see e.g., top lid 895). See e.g., FIG. 14 and FIG. 15.

In some embodiments, volume 807 of top cavity 803 may be for removable storage of a given liquid. In some embodiments, volume 837 of bottom cavity 833 may be shaped and sized to removably hold a predetermined number of cards, such as, but not limited to, credit cards 9991, ATM cards, identification (ID) cards (such as a driver's license), keys, hard currency (including coins), and/or the like.

For example, and without limiting the scope of the present invention, in some embodiments, volume 837 of bottom cavity 833 may extend into volume 807 of top cavity 803 by a bottom length 839. In some embodiments, bottom length 839 may be a longitudinal length of bottom cavity 833. In some embodiments, bottom cavity 833 may comprise bottom length 839. In some embodiments, an upper portion (e.g., top portion) of bottom cavity 833 may comprise roof portion 835. In some embodiments, top length 809 and bottom length 839 may be substantially parallel with each other. See e.g., FIG. 14. In some embodiments, top cavity 803 may comprise a top length 809 that may be a longitudinal length of top cavity 803. For example, and without limiting the scope of the present invention, in some embodiments, a ratio of top length 809 to bottom length 839 may be from 3 to 2. See e.g., FIG. 14.

In some embodiments, bottom cavity 833 may comprise a bottom major diameter 849, that may be a biggest inside diameter of bottom cavity 833. See e.g., FIG. 14. In some embodiments, bottom major diameter 849 may be at least large enough to fit a width of a credit card, such as credit card 9991; or of an object sized and shaped substantially similarly as a credit card; such as, but not limited to, ATM/debit card, ID cards, business cards, reward program cards, membership cards, insurance cards, and/or the like. In some embodiments, bottom major diameter 849 is at least 2.125 inches.

In some embodiments, top cavity 803 has a top major diameter 811, which may be a major inside diameter of top cavity 803. In some embodiments, bottom cavity 833 has bottom major diameter 849, which may be a major inside diameter of bottom cavity 833. In some embodiments, top major diameter 811 may be larger than bottom major diameter 849. For example, and without limiting the scope of the present invention, in some embodiments, a ratio of top major diameter 811 to bottom major diameter 849 may be from 1.6 to 1.3. See e.g., FIG. 14.

In some embodiments, main body 801 may be double hulled for insulation. In some embodiments, such a double hulled structure of main body 801 may comprise an exterior surface 871 and disposed opposite interior surface, that of a top interior surface 813. In some embodiments, top interior surface 813 may be an interior surface of top cavity 803. In some embodiments, a bottom interior surface 851 may be an interior surface of bottom cavity 833. In some embodiments, portions of top interior surface 813 may surround portions of bottom interior surface 851. In some embodiments, there may be a fixed gap between a given region of exterior surface 871 and a proximate given region of top interior surface 813. Likewise, in some embodiments, there may be a different fixed gap between a given region of top interior surface 813 and a proximate given region of bottom interior surface 851. In some embodiments, such a gap or different gap, may be at least partially filled with an insulator and/or an insulating material, which might include, air, foam, vacuum, and/or the like. See e.g., FIG. 14.

In some embodiments, one or more of exterior surface 871 and/or top interior surface 813 may be opaque, as in not transparent; wherein such embodiments may facilitate bottom cavity 833 being exteriorly hidden from view. Such embodiments may facilitate bottom cavity 833 being a hidden cavity to secretly removably store various articles, including articles of value, such as credit cards 9991, ATM/debit cards, ID cards, keys, hard currency, and/or the like. Whereas in other embodiments, one or more of exterior surface 871, top interior surface 813, and/or bottom interior surface 851 may be substantially transparent.

In some embodiments, at least a portion of bottom interior surface 851 may be coated with a material to reduce noise from articles removably held within bottom cavity 833. In some embodiments, this material may be one or more of: a foam, a plastic, an elastomer, a rubber, a silicone, and/or the like.

In some embodiments, main body 801 may be manufactured as a single integral article of manufacture. See e.g., FIG. 10. In some embodiments, main body 801 may be substantially constructed from a metal; such as but not limited to, a stainless steel. In some embodiments, the main body 801 may be substantially constructed from a thermoplastic via injection molding and/or 3D printing.

Note, in some embodiments, canteen 800 may comprise insert 1600. However, some embodiments of canteen 800 may not utilize insert 1600.

In some embodiments, top opening 815 may provide access to top cavity 803. In some embodiments, threading 817 may be located at or proximate (e.g., within one inch) to top opening 815. See e.g., FIG. 10, FIG. 12, FIG. 13, FIG. 14, and FIG. 15.

In some embodiments, bottom opening 853 may provide access to bottom cavity 833. In some embodiments, threading 855 may be located at or proximate (e.g., within one inch) to bottom opening 853. See e.g., FIG. 9, FIG. 10, FIG. 11, FIG. 12, FIG. 13, FIG. 14, and FIG. 15.

Figure 16A:
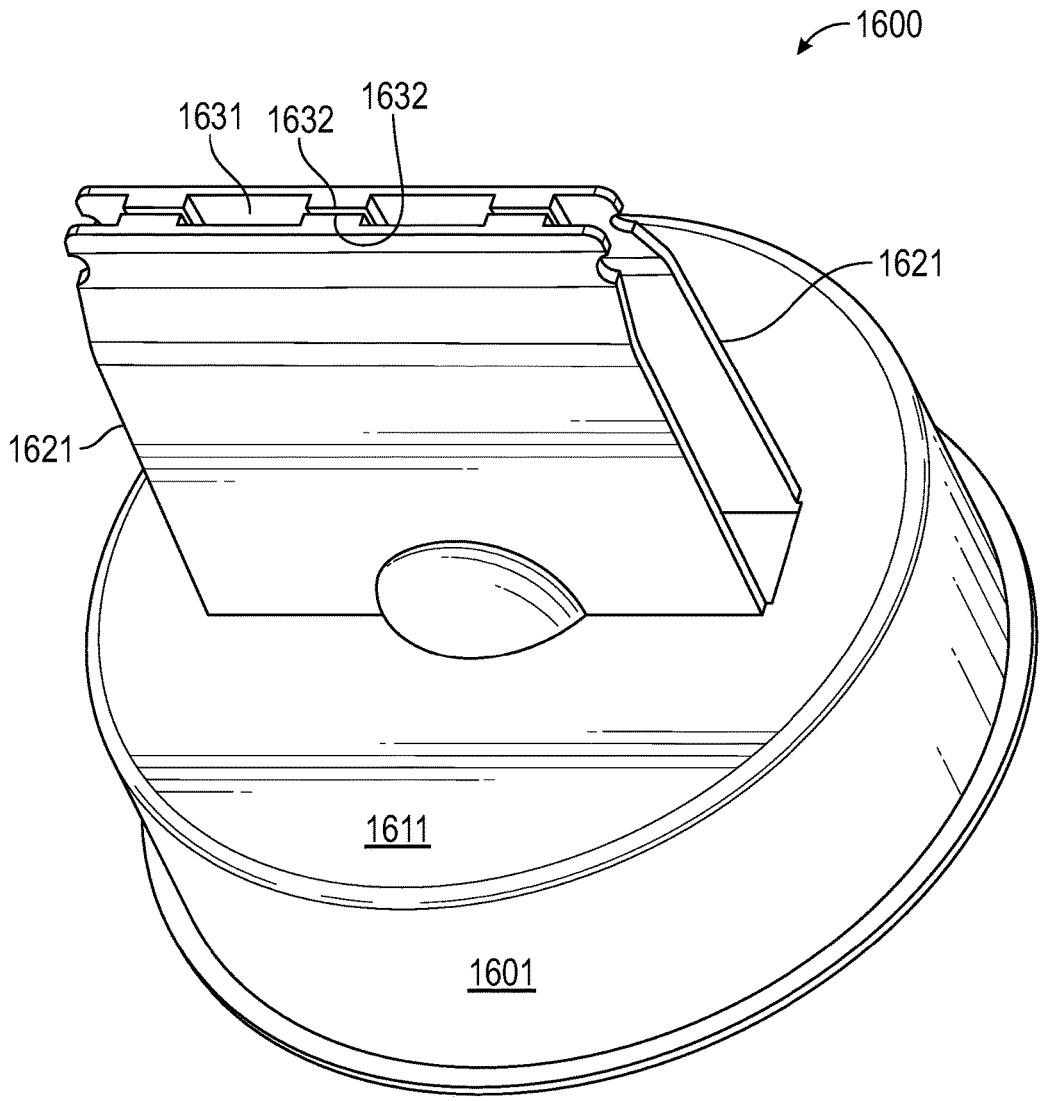
FIG. 16A may depict a perspective view of an embodiment of an insert; wherein this insert may have been used with the canteen of FIG. 8.
Figure 16B:
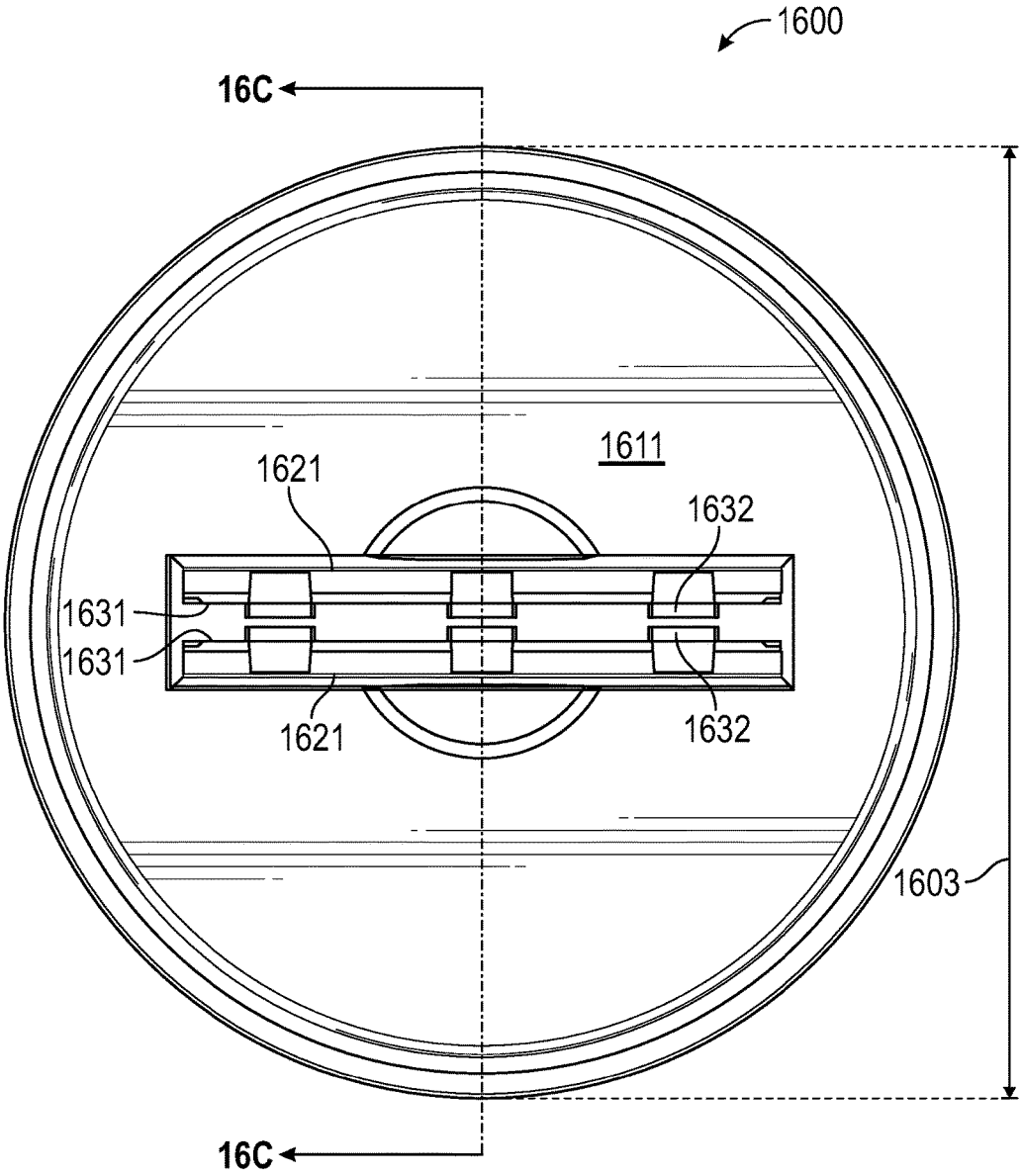
FIG. 16B may depict the insert of FIG. 16A, from a top view; and sectional-line 16C-16C may also be shown in FIG. 16B.
Figure 16C:
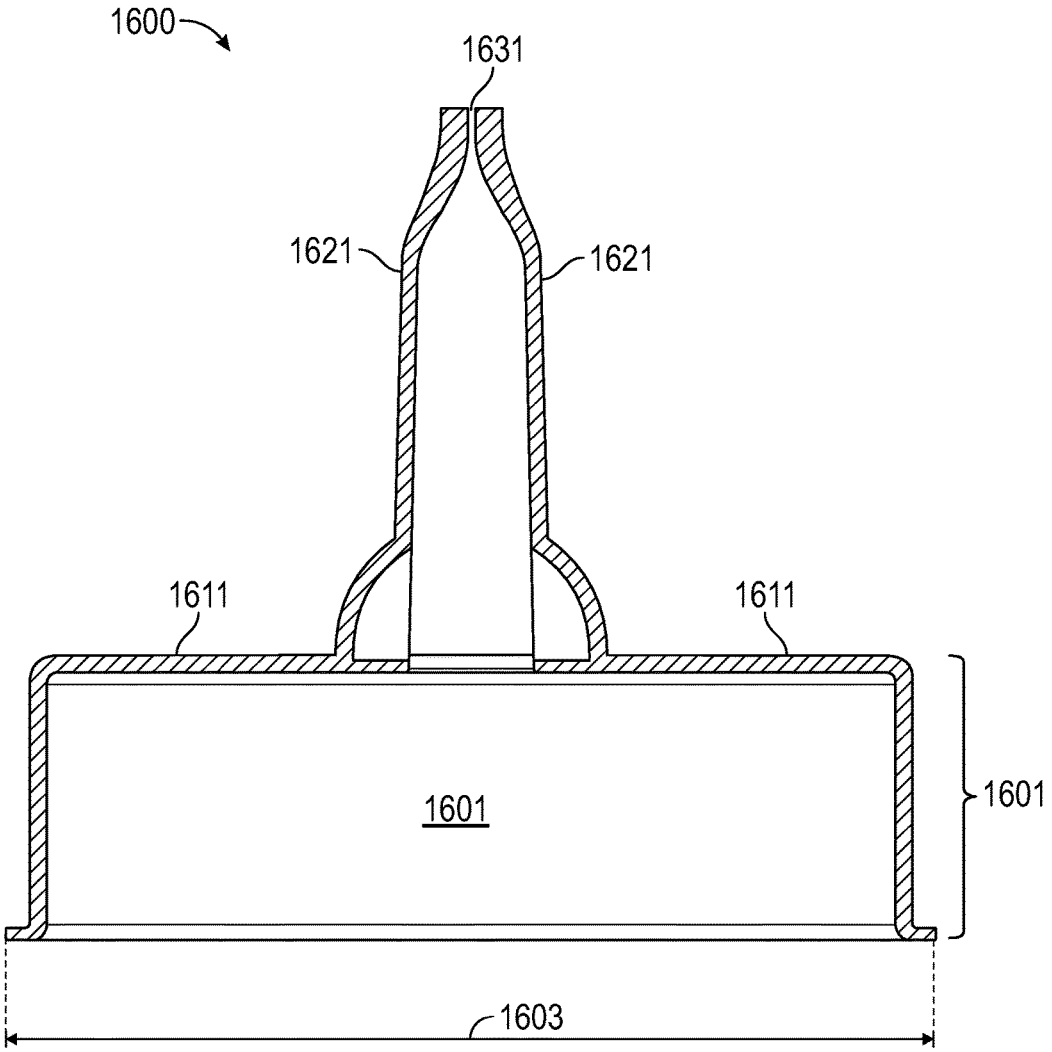
FIG. 16C may depict a cross-section of the insert of FIG. 16A along sectional-line 16C-16C shown in FIG. 16B.
Figure 16D:
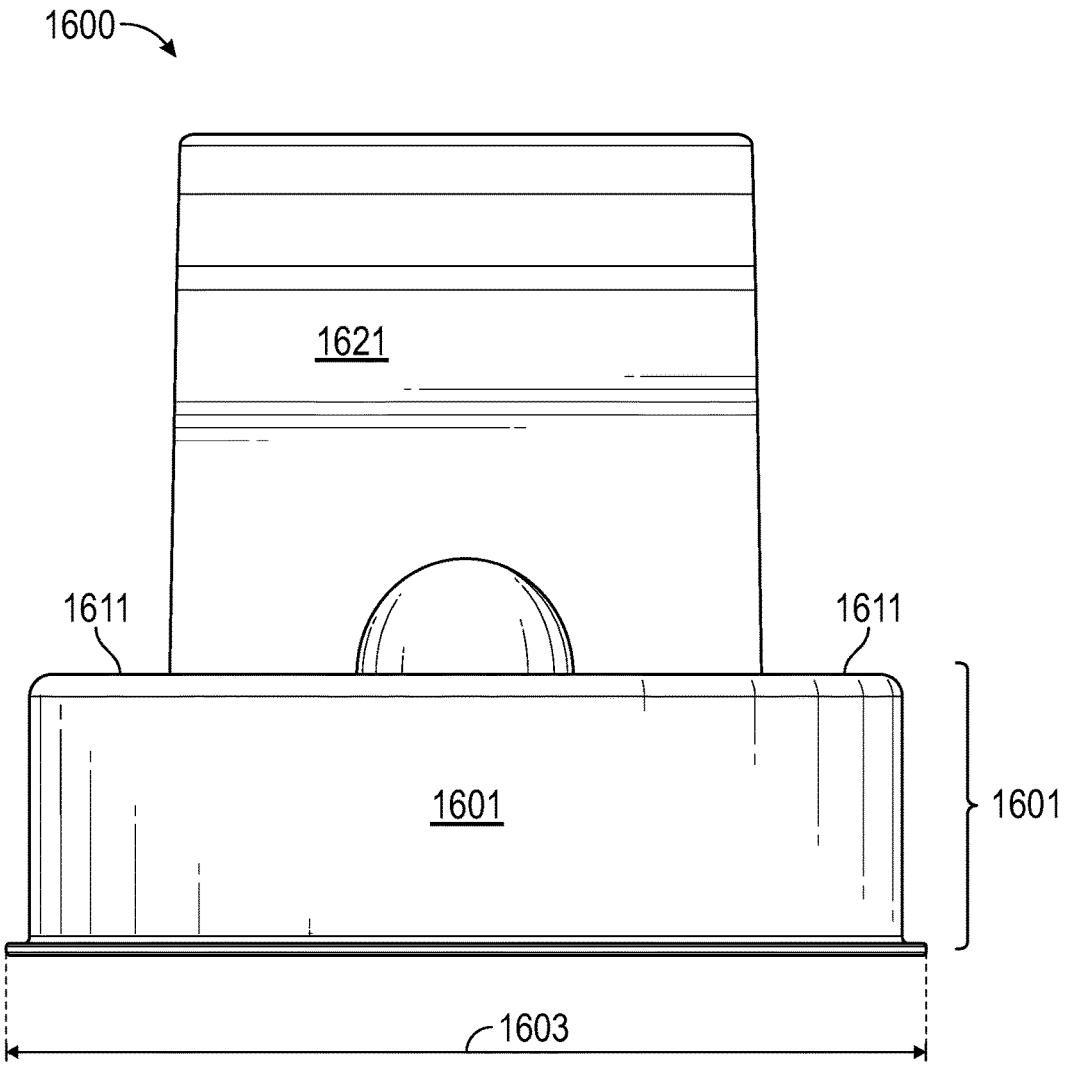
FIG. 16D may depict the insert of FIG. 16A, from a side view.

FIG. 16A may depict a perspective view of an embodiment of an insert 1600; wherein this insert 1600 may have been used with canteen 800. FIG. 16B may depict insert 1600, from a top view; and sectional-line 16C-16C may also be shown in FIG. 16B. FIG. 16C may depict a cross-section of insert 1600 along sectional-line 16C-16C shown in FIG. 16B. FIG. 16D may depict insert 1600, from a side view.

In some embodiments, canteen 800 may comprise insert 1600. In some embodiments, insert 1600 may removably hold at least one credit card 9991 or at least one article substantially similar in shape and dimension to the at least one credit card 9991. In some embodiments, insert 1600 may be removably insertable into bottom cavity 833. (In some embodiments, insert 1600 may be removably insertable into bottom cavity 1733, see e.g., FIG. 17A for bottom cavity 1733.) In some embodiments, insert 1600 may reduce movement of credit cards 9991 (or similar articles) being removably held by insert 1600 within bottom cavity 833. See e.g., FIG. 10, FIG. 11, and FIG. 12, for how insert 1600 may removably grip a given credit card 9991 (or similar articles); and see FIG. 16A, FIG. 16B, FIG. 16C, and FIG. 16D for structures and geometry of insert 1600.

In some embodiments, insert 1600 may comprise a cylindrically shaped cup portion 1601 and a pair of gripping arms 1621. In some embodiments, cylindrically shaped cup portion 1601 may have a bottom portion 1611. In some embodiments, bottom portion 1611 may be substantially flat and/or substantially planar. In some embodiments, pair of gripping arms 1621 may be opposing each other. In some embodiments, pair of gripping arms 1621 may extend substantially orthogonally from bottom portion 1611 terminating in a slot 1631 between ends of pair of gripping arms 1621. In some embodiments, this slot 1631 may be sized to removably grip at least one credit card 9991 or the at least one article that may be removably disposed within this slot 1631. See e.g., FIG. 10, FIG. 11, and FIG. 12, for how insert 1600 may removably grip a given credit card 9991 (or similar articles); and see FIG. 16A, FIG. 16B, FIG. 16C, and FIG. 16D for structures and geometry of insert 1600.

In some embodiments, cylindrically shaped cup portion 1601 has an outside diameter 1603. See e.g., FIG. 16C and FIG. 16D. In some embodiments, outside diameter 1603 may be sized to within the bottom major diameter 849.

In some embodiments, terminal ends of pair of gripping arms 1621, at slot 1631, may comprise opposing teeth 1632. See e.g., FIG. 16A. Such opposing teeth 1632 may narrow slot 1631. In some embodiments, such opposing teeth 1632 may facilitate removable gripping of a given credit card 9991 by pair of gripping arms 1621, removably held within slot 1631.

Note, insert 1600 may be utilized with canteen 800, as noted above, or with canteen 1700. Canteen 1700 is discussed next.

Figure 17A:
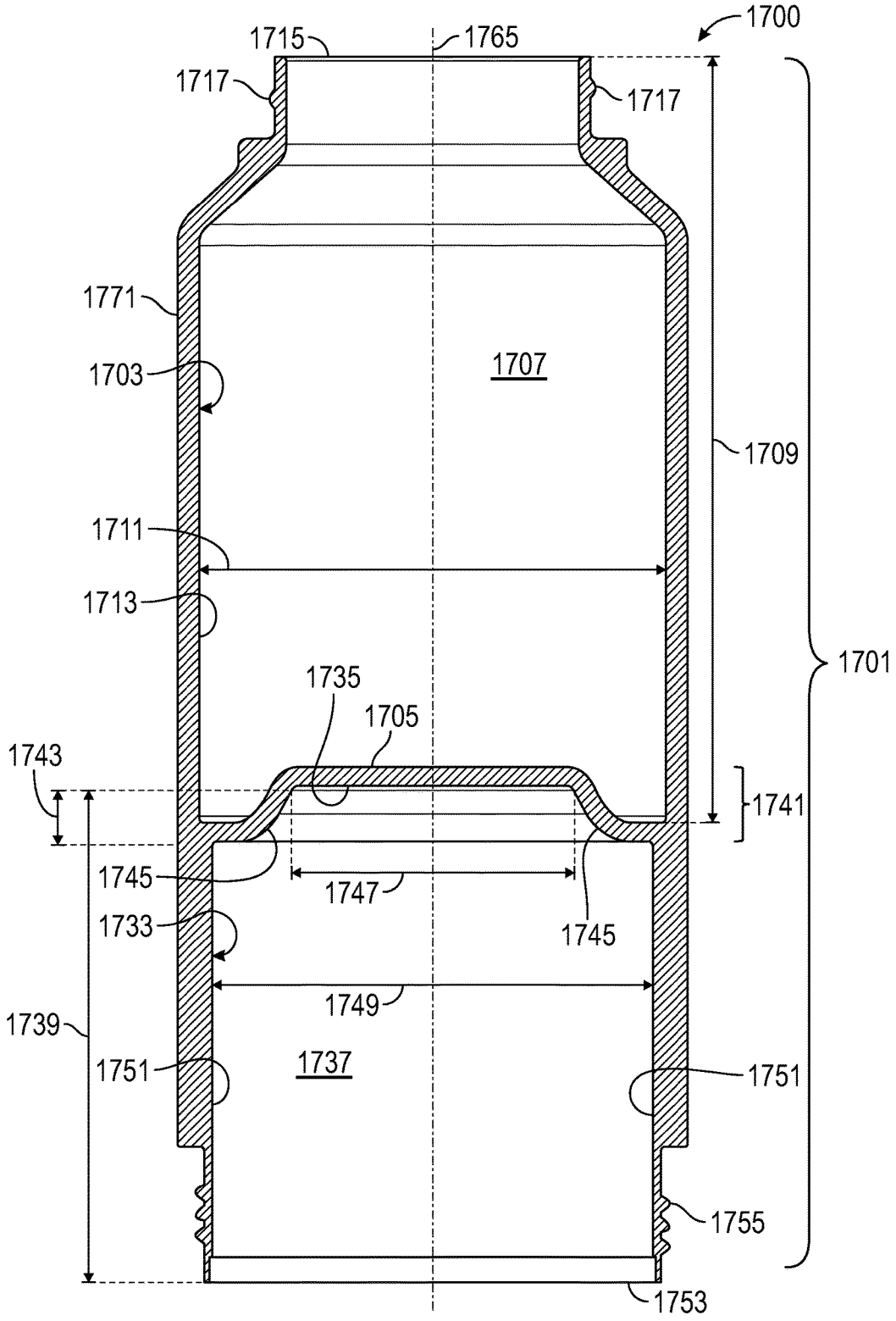
FIG. 17A may depict an embodiment of a canteen with storage compartments, shown in a longitudinal cross-section, showing interior structures and geometry of this canteen.

FIG. 17A may depict an embodiment of a canteen 1700 with storage compartments, shown in a longitudinal cross-section. In some embodiments, such storage compartments may be two different cavities within canteen 1700. In some embodiments, canteen 1700 may comprise a main body 1701. In some embodiments, main body 1701 may be exteriorly substantially shaped as a cylinder. In some embodiments, main body 1701 may comprise the two different cavities. In some embodiments, these two different cavities may be a top cavity 1703 and a bottom cavity 1733. In some embodiments, these two different cavities may be longitudinally disposed of each other, such that a bottom portion 1705 of top cavity 1703 may be disposed above a roof portion 1735 of the bottom cavity 1733; with respect to a same or a common longitudinal direction, such as shared central longitudinal axis 1765. In some embodiments, top cavity 1703 may remain sealed and/or isolated from bottom cavity 1733, such that contents of top cavity 1703 may not physically contact contents of bottom cavity 1733. See e.g., FIG. 17A.

Continuing discussion FIG. 17A, in some embodiments, top cavity 1703 may comprise a volume 1707. In some embodiments, bottom cavity 1733 may comprise a volume 1737. In some embodiments, volume 1737 of bottom cavity 1733 may extend, e.g., partially, into volume 1707 of top cavity 1703 in a manner that may be radially symmetrical about a shared central longitudinal axis 1765 of both top cavity 1703 and bottom cavity 1733. In some embodiments, top cavity 1703 may be radially symmetrical with respect to shared central longitudinal axis 1765. In some embodiments, bottom cavity 1733 may be radially symmetrical with respect to shared central longitudinal axis 1765. In some embodiments, access to top cavity 1703 and/or to volume 1707 may be via top opening 1715. In some embodiments, top opening 1715 may be located a top of main body 1701. In some embodiments, at and/or proximate to top opening 1715 may be threading 1717. In some embodiments, threading 1717 may removably couple to complimentary threading located on a top lid (see e.g., top lid 895). See e.g., FIG. 17A.

In some embodiments, volume 1707 of top cavity 1703 may be for removable storage of a given liquid. In some embodiments, volume 1737 of bottom cavity 1733 may be shaped and sized to removably hold a predetermined number of cards, such as, but not limited to, credit cards 9991, ATM cards, identification (ID) cards (such as a driver's license), keys, hard currency (including coins), a smartphone 9995, and/or the like.

Continuing discussion FIG. 17A, in some embodiments, volume 1737 of bottom cavity 1733 may extend into volume 1707 of top cavity 1703 only minimally. For example, and without limiting the scope of the present invention, in some embodiments, volume 1737 of bottom cavity 1733 may extend into volume 1707 of top cavity 1703 by a nipple height 1743. In some embodiments, nipple height 1743 may be a height of a nipple region 1741. In some embodiments, nipple region 1741 may be an upper portion of bottom cavity 1733. In some embodiments, bottom cavity 1733 may comprise nipple region 1741. In some embodiments, nipple region 1741 may comprise roof portion 1735. See e.g., FIG. 17A. In some embodiments, top cavity 1703 may comprise a top length 1709 that may be a longitudinal length of top cavity 1703. For example, and without limiting the scope of the present invention, in some embodiments, a ratio of top length 1709 to nipple height 1743 may be from 14 to 12. See e.g., FIG. 17A.

Continuing discussion FIG. 17A, in some embodiments, bottom cavity 1733 may comprise a bottom major diameter 1749, that may be a biggest inside diameter of bottom cavity 1733. In some embodiments, nipple region 1741 may comprise a bottom minor diameter 1747. In some embodiments, bottom major diameter 1749 may be larger than bottom minor diameter 1747. In some embodiments, bottom minor diameter 1747 may be measured at roof portion 1735. In some embodiments, bottom interior surface 1751 associated with bottom major diameter 1749 may smoothly transition into bottom minor diameter 1747 by a taper 1745. In some embodiments, taper 1745 may comprise one or more predetermined radii. In some embodiments, a ratio of bottom major diameter 1749 to bottom minor diameter 1747 may be from 1.7 to 1.5. See e.g., FIG. 17A.

In some embodiments, bottom minor diameter 1747 may be at least large enough to fit a width of a credit card, such as credit card 9991; or of an object sized and shaped substantially similarly as a credit card; such as, but not limited to, ATM/debit card, ID cards, business cards, reward program cards, membership cards, insurance cards, and/or the like. In some embodiments, bottom minor diameter 1747 is at least 2.125 inches.

Continuing discussion FIG. 17A, in some embodiments, top cavity 1703 has a top major diameter 1711, that may be a major inside diameter of top cavity 1703. In some embodiments, bottom cavity 1733 has a bottom major diameter 1749, which may be a major inside diameter of bottom cavity 1733. In some embodiments, top major diameter 1711 may be substantially a same dimension as bottom major diameter 1749. See e.g., FIG. 17A.

Continuing discussion FIG. 17A, in some embodiments, top cavity 1703 has a top length 1709; which may be a longitudinal length of top cavity 1703. In some embodiments, bottom cavity 1733 has a bottom length 1739; which may be a longitudinal length of bottom cavity 1733. In some embodiments, top length 1709 and bottom length 1739 may be substantially parallel with each other. For example, and without limiting the scope of the present invention, in some embodiments, a ratio of top length 1709 to bottom length 1739 may be from 1.6 to 1.4. In some embodiments, nipple height 1743 may be a sub-length of bottom length 1739. See e.g., FIG. 17A.

Continuing discussion FIG. 17A, in some embodiments, main body 1701 may be double hulled for insulation. In some embodiments, such a double hulled structure of main body 1701 may comprise an exterior surface 1771 and disposed opposite two interior surfaces, that of a top interior surface 1713 and of a bottom interior surface 1751, respectively. In some embodiments, top interior surface 1713 may be an interior surface of top cavity 1703. In some embodiments, bottom interior surface 1751 may be an interior surface of bottom cavity 1733. In some embodiments, there may be a fixed gap between a given region of exterior surface 1771 and a proximate given region of top interior surface 1713. Likewise, in some embodiments, there may be a fixed gap (which may be different gap) between a given region of exterior surface 1771 and a proximate given region of bottom interior surface 1751. In some embodiments, such a gap or different gap, may be at least partially filled with an insulator and/or an insulating material, which might include, air, foam, vacuum, and/or the like. See e.g., FIG. 17A.

In some embodiments, one or more of exterior surface 1771, top interior surface 1713, and/or bottom interior surface 1751 may be opaque, as in not transparent; wherein such embodiments may facilitate bottom cavity 1733 being exteriorly hidden from view. Such embodiments may facilitate bottom cavity 1733 being a hidden cavity to secretly removably store various articles, including articles of value, such as credit cards 9991, ATM/debit cards, ID cards, a smartphone 9995, keys, hard currency, and/or the like. Whereas in other embodiments, one or more of exterior surface 1771, top interior surface 1713, and/or bottom interior surface 1751 may be substantially transparent.

In some embodiments, at least a portion of bottom interior surface 1751 may be coated with a material to reduce noise from articles removably held within bottom cavity 1733. In some embodiments, this material may be one or more of: a foam, a plastic, an elastomer, a rubber, a silicone, and/or the like.

In some embodiments, main body 1701 may be manufactured as a single integral article of manufacture. See e.g., FIG. 17A. In some embodiments, main body 1701 may be substantially constructed from a metal; such as but not limited to, a stainless steel. In some embodiments, the main body 1701 may be substantially constructed from a thermoplastic via injection molding and/or 3D printing.

Note, in some embodiments, canteen 1700 may comprise insert 1600; wherein insert 1600 may be used as described for use in canteen 800. However, some embodiments of canteen 1700 may not utilize insert 1600.

Figure 17B:
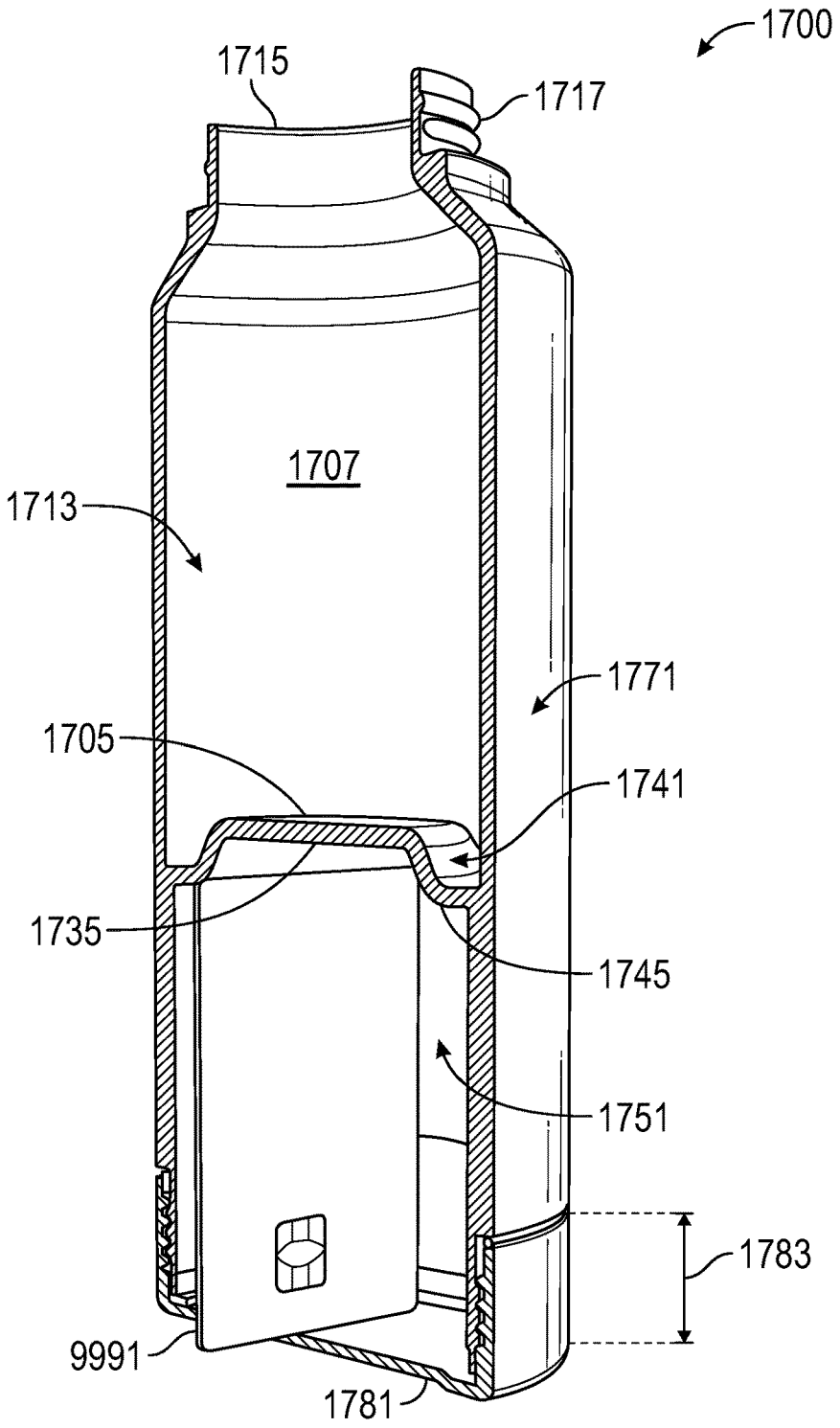
FIG. 17B may depict may depict the canteen of FIG. 17A, in a perspective cross-sectional view, showing at least one credit card removably stored within a bottom cavity of this canteen; and wherein the canteen may be fitted with a short bottom lid.

FIG. 17B may depict may depict canteen 1700, in a perspective cross-sectional view, showing at least one credit card 9991 removably stored within a bottom cavity 1733; and wherein canteen 1700 may be fitted with a short bottom lid 1781. In some embodiments, canteen 1700 may comprise short bottom lid 1781. In some embodiments, short bottom lid 1781 may removably attach to bottom opening 1753; e.g., via bottom threading 1755 and complimentary threading located on short bottom lid 1781. In some embodiments, nipple region 1741 may be sized and shaped to removably hold at least one credit card 9991 upright within bottom cavity 1733 when short bottom lid 1781 may be removably sealing a bottom opening 1753 to bottom cavity 1733. In some embodiments, a height (e.g., a short lid length 1783) of short bottom lid 1781 may contribute to a size of bottom cavity 1733; i.e., may contribute to a size of volume 1737. See e.g., FIG. 17A and FIG. 17B.

Figure 17C:
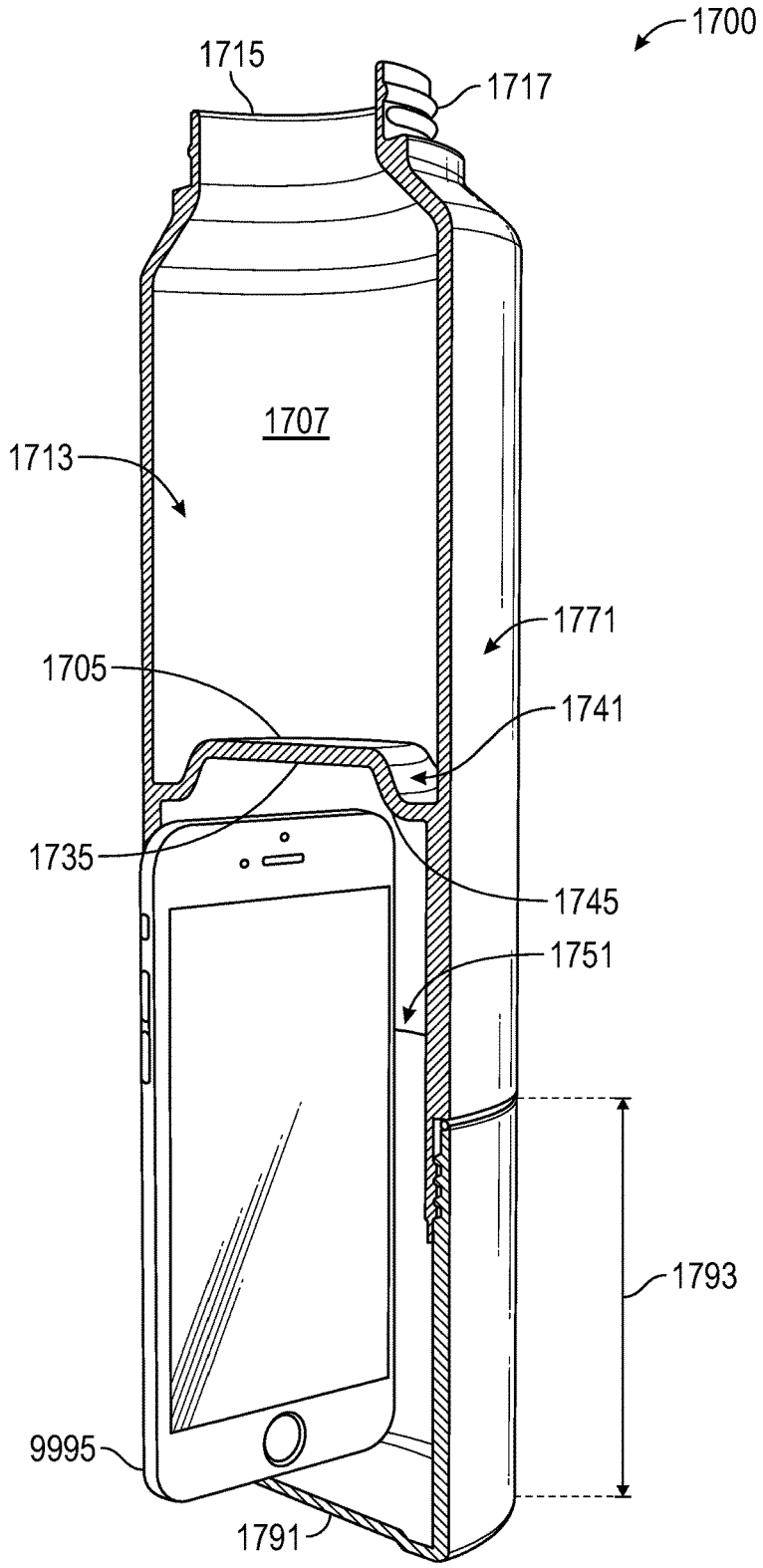
FIG. 17C may depict may depict the canteen of FIG. 17A, in a perspective cross-sectional view, showing at least one smartphone removably stored within the bottom cavity; and wherein the canteen may be fitted with a long bottom lid.

FIG. 17C may depict may depict canteen 1700, in a perspective cross-sectional view, showing at least one smartphone 9995 removably stored within bottom cavity 1733; and wherein canteen 1700 may be fitted with a long bottom lid 1791. In some embodiments, canteen 1700 may comprise long bottom lid 1791. In some embodiments, long bottom lid 1791 may removably attach to bottom opening 1753; e.g., via bottom threading 1755 and complimentary threading located on long bottom lid 1791. In some embodiments, nipple region 1741 may be sized and shaped to removably hold at least one smartphone 9995 upright within bottom cavity 1733 when long bottom lid 1791 may be removably sealing bottom opening 1753 of bottom cavity 1733. In some embodiments, a height (e.g., a long lid length 1793) of long bottom lid 1791 may contribute to a size of bottom cavity 1733; i.e., may contribute to a size of volume 1737. See e.g., FIG. 17A and FIG. 17C.

In some embodiments, canteen 1700 may comprise two different removable bottom lids, short bottom lid 1781 and long bottom lid 1791. In some embodiments, short bottom lid 1781 has a short lid length 1783; see e.g., FIG. 17B. In some embodiments, long bottom lid 1791 has a long lid length 1793; see e.g., FIG. 17C. In some embodiments, long lid length 1793 may be longer than short lid length 1783. In some embodiments, only one of these two different removable bottom lids may removably seal bottom opening 1753 of bottom cavity 1733 at a time. For example, and without limiting the scope of the present invention, in some embodiments, a ratio of long lid length 1793 to short lid length 1783 may be from 3.3 to 3.0. See e.g., FIG. 17B and FIG. 17C.

In some embodiments, use of such different sized bottom lids, as short bottom lid 1781 and long bottom lid 1791, may permit different sized articles (e.g., objects) to be removably stored within bottom cavity 1733, depending upon the given bottom lid utilized. For example, and without limiting the scope of the present invention, use of short bottom lid 1781 may permit storage of at least one credit card 9991 within bottom cavity 1733; while use of long bottom lid 1791 may permit storage of at least one smartphone 9995 within bottom cavity 1733. See e.g., FIG. 17B and FIG. 17C.

Note, in some embodiments, exteriorly, canteen 1700 and canteen 800 may be substantially similar, at least when short bottom lid 1781 may be used for canteen 1700. Note, in some embodiments, exteriorly, main body 1701 and main body 801 may be substantially similar. For example, top lid 895 may be used with main body 1701; wherein complimentary threads of top lid 895 may removably couple with top threading 1717 of main body 1701 to removably seal top opening 1715.

In some embodiments, the canteens (e.g., 100, 700, 800, and/or 1700) discussed above, with or without inserts (e.g., 721 and/or 1600), may be used in a method (or methods) for removably concealing at least one article within the bottom cavity (e.g., 121, 131, 833, and/or 1733) of the given canteen. In some embodiments, the method may comprise steps of: (a) placing the at least one article at least partially through a bottom opening (e.g., 853 and/or 1753) of the bottom cavity into a volume (e.g., 837 and/or 1737) of the bottom cavity; and (b) removably sealing the bottom opening of the bottom cavity with a bottom lid (e.g., 133, 881, 1781, and/or 1791) of the canteen. In such embodiments, exterior surfaces of the given canteen may be substantially opaque, including exterior surfaces of the canteen's main body (e.g., 407, 871, and/or 1771) and of the removably attached bottom lid (e.g., 133, 881, 1781, and/or 1791).

In some embodiments, this at least one article may be selected from: a credit card 9991, a ATM card, a debit card, an identification card, driver's license, a social security card, insurance cards, medical cards, membership cards, coupon cards, a business card, a smartphone 9995, keys, coins, hard currency, and/or the like. In some embodiments, the volume of the bottom cavity may be specifically sized and shaped to accommodate the at least one article. In some embodiments, the bottom lid may be specifically sized and shaped to accommodate the at least one article.

In some embodiments of this method for removably concealing at least one article within the bottom cavity (e.g., 121, 131, 833, and/or 1733) of the given canteen, between steps (a) and (b), may comprise an additional step of selecting which bottom lid to use in step (b); wherein the bottom lid selected may be selected from short bottom lid 1781 (e.g., if the at least one article may be at least one credit card 9991) or long bottom lid 1791 (e.g., if the at least one article may be a smartphone 9995).

In some embodiments, insert 721 and/or insert 1600 may be substantially constructed from one or more of an elastomer (e.g., a silicone and/or a rubber), a thermoformed plastic, and/or a metal. In some embodiments, insert 721 may be substantially constructed from food grade materials.

In some embodiments, one or more components of canteen 100, of canteen 700, of canteen 800, and/or of canteen 1700 may be substantially constructed from food grade materials. In some embodiments, one or more components of canteen 100, of canteen 700, of canteen 800, and/or of canteen 1700 may be substantially constructed from one or more of: a metal, a thermoformed plastic, an elastomer, a foam, and/or a glass. For example, and without limiting the scope of the present invention, such a metal may be a type of stainless steel. For example, and without limiting the scope of the present invention, such a thermoformed plastic may be a acrylonitrile-butadiene styrene (ABS), polyvinyl chloride (PVC), polycarbonate, nylon, polypropylene, polyethylene (e.g., HDPE), and/or the like. For example, and without limiting the scope of the present invention, such an elastomer may be a silicone, a rubber (e.g., latex or synthetic), or a flexible thermoformed plastic. Such thermoplastics and/or elastomers may be BPA (bisphenol A) free.

In various exemplary embodiments, canteen 100, canteen 700, canteen 800, canteen 1700, and/or at least one of its components may be substantially constructed of one or more thermoplastics suitable for injection molding and/or three dimensional (3D) printing. For example, and without limiting the scope of the present invention, various exemplary embodiments of canteen 100, canteen 700, canteen 800, canteen 1700, and/or at least one of its components may be substantially constructed of one or more materials of ABS, PVC, polycarbonate, nylon, polypropylene, polyethylene (e.g., HDPE), and/or the like. Such thermoplastics may be BPA (bisphenol A) free.

In some embodiments, card cavity 121, insert 721, bottom cavity 833, insert 1600, and/or bottom cavity 1733 may be lined with, coated with, or constructed from the elastomer, so as to: minimize movement of removably held articles/objects (e.g., cards); to facilitate frictional gripping of the cards removably held within the given bottom storage compartment; and/or to minimize sound originating from the removably held articles/objects (e.g., keys and/or coins) within the given storage compartment.

Note with respect to the materials of construction, it is not desired nor intended to thereby unnecessarily limit the present invention by reason of such disclosure.

Various portable (mobile) canteens with storage compartments (e.g., canteen 100, canteen 700, canteen 800, and/or canteen 1700) have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A canteen for removably concealing at least one article within a bottom cavity of the canteen, wherein the canteen comprises:

a main body; wherein the main body comprises:

an exterior surface that is substantially opaque exteriorly hiding the bottom cavity;

a top cavity and the bottom cavity both of which are formed from the main body;

wherein the top cavity and the bottom cavity are longitudinally disposed of each other in a manner that a bottom portion of the top cavity is disposed above a roof portion of the bottom cavity;

wherein a volume of the top cavity is bound by a top interior surface of the top cavity that runs from a top opening of the top cavity to the bottom portion of the top cavity, wherein the top opening of the top cavity is disposed above the bottom portion of the top cavity; wherein a volume of the bottom cavity is bound by a bottom interior surface of the bottom cavity that runs from a bottom opening of the bottom cavity to the roof portion of the bottom cavity, wherein the bottom opening of the bottom cavity is disposed beneath the roof portion of the bottom cavity; wherein less than a majority of the volume of the bottom cavity extends into the volume of the top cavity in a manner that is radially symmetrical about a shared central longitudinal axis of both the top cavity and the bottom cavity; and a bottom lid, wherein the bottom lid is of a fixed length, wherein the bottom lid is closed at an end distal from the roof portion of the bottom cavity, wherein the bottom lid is substantially hollow, wherein the bottom lid removably seals the bottom opening of the bottom cavity, wherein removable attachment of the bottom lid to the main body allows the at least one article to be removably concealed within the bottom cavity.

2. The canteen according to claim 1; wherein the volume of the bottom cavity extends into the volume of the top cavity by a nipple height; wherein the nipple height is a height of a nipple region; wherein the nipple region is an upper portion of the bottom cavity; wherein the nipple region comprises the roof portion.

3. The canteen according to claim 2; wherein the top cavity comprises a top length that is a longitudinal length of the top cavity; wherein a ratio of the top length to the nipple height is from 14 to 12.

4. The canteen according to claim 2; wherein the nipple region is sized and shaped to removably hold at least one credit card upright within the bottom cavity when the bottom lid is removably sealing the bottom opening to the bottom cavity, wherein the least one credit card is selected from the at least one article.

5. The canteen according to claim 2; wherein the canteen further comprises a long bottom lid for removably sealing the bottom opening of the bottom cavity; wherein the nipple region is sized and shaped to removably hold at least one smartphone upright within the bottom cavity when the long bottom lid is removably sealing the bottom opening of the bottom cavity, wherein the least one smartphone is selected from the least one article.

6. The canteen according to claim 2; wherein the bottom cavity comprises a bottom major diameter; and wherein the nipple region comprises a bottom minor diameter; wherein the bottom major diameter is larger than the bottom minor diameter.

7. The canteen according to claim 6, wherein the bottom minor diameter is at least large enough to fit a width of a credit card, such that a portion of the credit card is removably held within the nipple region and upright within the bottom cavity when the bottom lid is removably attached to the main body to removably seal the bottom opening of the bottom cavity, wherein the credit card is selected from the at least one article.

8. The canteen according to claim 6, wherein the bottom minor diameter is at least 2.125 inches, such that a portion of a credit card is removably held within the nipple region and upright within the bottom cavity when the bottom lid is removably attached to the main body to removably seal the bottom opening of the bottom cavity, wherein the credit card is selected from the at least one article.

9. The canteen according to claim 2, wherein with respect to a direction from the bottom opening to the top opening of the canteen, the nipple region comprises a taper of a predetermined and fixed radius that leads to the roof portion of the bottom cavity.

10. The canteen according to claim 1, wherein the top cavity has a top major diameter; wherein the bottom cavity has a bottom major diameter; wherein the top major diameter is substantially a same dimension as the bottom major diameter.

11. The canteen according to claim 1, wherein the top cavity has a top length; wherein the bottom cavity has a bottom length; wherein a ratio of the top length to the bottom length is from 1.6 to 1.4, wherein this ratio is configured for when the at least one article comprises a credit card or a smartphone.

12. The canteen according to claim 1, wherein the canteen further comprises a long bottom lid for removably sealing the bottom opening of the bottom cavity; wherein the bottom lid has a short lid length; wherein the long bottom lid has a long lid length; wherein the long lid length is longer than the short lid length; wherein only the bottom lid or the long bottom lid removably seals the bottom opening of the bottom cavity at a time.

13. The canteen according to claim 12, wherein a ratio of the long lid length to the lid length is from 3.3 to 3.0, wherein this ratio is configured for when the at least one article comprises a credit card or a smartphone, wherein the bottom lid is for use with the credit card and the long bottom lid is for use with a smartphone.

14. The canteen according to claim 1, wherein the main body is double hulled for insulation, comprising the exterior surface and disposed opposite the top interior surface and the bottom interior surface; wherein the top interior surface is an interior surface of the top cavity; and wherein the bottom interior surface is an interior surface of the bottom cavity.

15. The canteen according to claim 14, wherein at least a portion of the bottom interior surface is coated with a material to reduce noise from the at least one article removably held within the bottom cavity.

16. The canteen according to claim 1, wherein the main body is manufactured as a single integral article of manufacture.

17. The canteen according to claim 1, wherein the canteen further comprises an insert; wherein the insert removably holds at least one credit card or at least one article substantially similar in shape and dimension to the at least one credit card; wherein the insert is removably insertable into the bottom cavity.

18. The canteen according to claim 17, wherein the insert comprises:

a cylindrically shaped cup portion with a bottom portion;

a pair of gripping arms that are opposing each other;

wherein the pair of gripping arms extend substantially orthogonally from the bottom portion terminating in a slot between ends of the pair of gripping arms; wherein this slot is sized to removably grip the at least one credit card or the at least one article is that is removably disposed within this slot.

19. The canteen according to claim 18, wherein the cylindrically shaped cup portion has an outside diameter; wherein the bottom cavity has a bottom major diameter; wherein the outside diameter is sized to within the bottom major diameter.

20. A method for removably concealing at least one article within a bottom cavity of a canteen; wherein the method comprises steps of:

placing the at least one article at least partially through a bottom opening of the bottom cavity into a volume of the bottom cavity; and removably sealing the bottom opening of the bottom cavity with a bottom lid of the canteen;

wherein the canteen comprises:

a main body with an exterior surface that is substantially opaque exteriorly hiding the bottom cavity;

a top cavity and the bottom cavity both of which are formed from the main body;

wherein the top cavity and the bottom cavity are longitudinally disposed of each other in a manner that a bottom portion of the top cavity is disposed above a roof portion of the bottom cavity;

the bottom lid of the canteen; wherein exterior surfaces of the bottom lid are substantially opaque; wherein the bottom lid is closed at an end distal from the roof portion of the bottom cavity; wherein the bottom lid is substantially hollow;

wherein the bottom lid is specifically sized to accommodate the at least one article; wherein the bottom lid removably seals a bottom opening of the bottom cavity, wherein removable attachment of the bottom lid to the main body allows the least one article to be removably concealed within the bottom cavity;

wherein a volume of the top cavity is bound by a top interior surface of the top cavity that runs from a top opening of the top cavity to the bottom portion of the top cavity, wherein the top opening of the top cavity is disposed above the bottom portion of the top cavity; wherein the volume of the bottom cavity is bound by a bottom interior surface of the bottom cavity that runs from the bottom opening of the bottom cavity to the roof portion of the bottom cavity, wherein the bottom opening of the bottom cavity is disposed beneath the roof portion of the bottom cavity; wherein less than a majority of the volume of the bottom cavity extends into the volume of the top cavity in a manner that is radially symmetrical about a shared central longitudinal axis of both the top cavity and the bottom cavity; and wherein the volume of the bottom cavity is specifically sized to accommodate the at least one article.

21. The method according to claim 20, wherein the at least one article is selected from: a credit card, an identification card, a social security card, a smartphone, keys, coins, or hard currency.

* * * * *